US009429903B2

(12) United States Patent
Sato

(10) Patent No.: US 9,429,903 B2
(45) Date of Patent: Aug. 30, 2016

(54) IMAGE FORMING APPARATUS HAVING CARTRIDGE

(71) Applicant: BROTHER KOGYO KABUSHIKI KAISHA, Nagoya-shi, Aichi-ken (JP)

(72) Inventor: Shougo Sato, Seto (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/667,737

(22) Filed: Mar. 25, 2015

(65) Prior Publication Data

US 2015/0277365 A1 Oct. 1, 2015

(30) Foreign Application Priority Data

Mar. 31, 2014 (JP) ..... 2014-074636

(51) Int. Cl.
*G03G 21/18* (2006.01)

(52) U.S. Cl.
CPC ..... *G03G 21/18* (2013.01); *G03G 21/1846* (2013.01); *G03G 2221/1846* (2013.01); *G03G 2221/1853* (2013.01)

(58) Field of Classification Search
CPC ..... G03G 2221/1846; G03G 21/1846; G03G 21/1817–21/1825
See application file for complete search history.

(56) References Cited

U.S. PATENT DOCUMENTS 7,580,653 B2 * 8/2009 Idehara ..... G03G 21/1628 399/110
8,712,258 B2 * 4/2014 Muranaka ..... G03G 15/55 399/12
2008/0145095 A1 6/2008 Hoshi et al.
2013/0251412 A1 * 9/2013 Okamoto ..... G03G 15/0877 399/258
2013/0287440 A1 * 10/2013 Ueda ..... G03G 15/60 399/125

FOREIGN PATENT DOCUMENTS

JP 2010217745 A * 9/2010
JP 2011008286 A 1/2011

* cited by examiner

*Primary Examiner* — Clayton E Laballe
*Assistant Examiner* — Leon W. Rhodes, Jr.
(74) *Attorney, Agent, or Firm* — Merchant & Gould P.C.

(57) ABSTRACT

An image forming apparatus includes a casing, a process cartridge and an exposure unit. The casing defines a first direction, a second direction orthogonal to the first direction, and a third direction orthogonal to the first direction and the second direction. The third direction extends vertically. The process cartridge includes a photosensitive body extending in the first direction and a grip having a portion. The exposure unit is configured to expose the photosensitive body. The exposure unit has a part overlapped with the process cartridge as viewed in the second direction when the process cartridge is mounted in the casing. The portion of the grip is overlapped with the exposure unit as viewed in the third direction when the process cartridge is mounted in the casing. The portion of the grip is disposed above the exposure unit in the third direction.

29 Claims, 10 Drawing Sheets

IMAGE FORMING APPARATUS HAVING CARTRIDGE

CROSS REFERENCE TO RELATED APPLICATION

This application claims priority from Japanese Patent Application No. 2014-074636 filed Mar. 31, 2014. The entire content of this priority application is incorporated herein by reference.

TECHNICAL FIELD

The present disclosure relates to an image-forming apparatus employing an electrophotographic system.

BACKGROUND

An electrophotographic image-forming apparatus known in the art is provided with a main body, and a process cartridge mounted in and removed from the main body and including a photosensitive drum.

In one such image-forming apparatus that has been proposed, the process cartridge is provided with a handle, and the main body is further provided with an optical system for irradiating light toward the photosensitive drum based on image data. The optical system is positioned on the front side of the process cartridge when the process cartridge is mounted in the main body. With this image-forming apparatus, the user grips the handle of the process cartridge to remove the process cartridge from the main body.

SUMMARY

However, in the process cartridge described above, the handle is provided between the process cartridge and the optical system in a horizontal direction. Consequently, space must be allocated in the image-forming apparatus between the handle and the optical system in the front-rear direction to allow the user to grip the handle, which makes it difficult to attain the compact image-forming apparatus in the front-rear direction.

In view of the foregoing, it is an object of the present disclosure to provide an image-forming apparatus that can be made more compact in a horizontal direction orthogonal to the vertical direction.

In order to attain above and other objects, the disclosure provides an image forming apparatus. The image forming apparatus may include a casing, a process cartridge, and an exposure unit. The casing may define a first direction, a second direction orthogonal to the first direction, and a third direction orthogonal to the first direction and the second direction. The third direction may extend vertically. The process cartridge may be configured to be mounted in and removed from the casing. The process cartridge may include a photosensitive body extending in the first direction and a grip having a portion. The exposure unit may be configured to expose the photosensitive body. The exposure unit may have a part overlapped with the process cartridge as viewed in the second direction when the process cartridge is mounted in the casing. The portion of the grip may be overlapped with the exposure unit as viewed in the third direction and disposed above the exposure unit in the third direction when the process cartridge is mounted in the casing.

According to another aspect, the disclosure provides an image forming apparatus. The image forming apparatus may include a casing, a photosensitive body, a developing cartridge, and an exposure unit. The casing may define a first direction, a second direction orthogonal to the first direction, and a third direction orthogonal to the first direction and the second direction. The third direction may extend vertically. The photosensitive body may extend in the first direction. The photosensitive body may be fixedly provided in the casing. The developing cartridge may be configured to be mounted in and removed from the casing and accommodate therein developing agent. The developing cartridge may include a grip having a portion. The exposure unit may be configured to expose the photosensitive body. The exposure unit may have a part overlapped with the process cartridge as viewed in the second direction when the developing cartridge is mounted in the casing. The portion of the grip may be overlapped with the exposure unit as viewed in the third direction and disposed above the exposure unit in the third direction when the developing cartridge is mounted in the casing.

BRIEF DESCRIPTION OF THE DRAWINGS

The particular features and advantages of the embodiments as well as other objects will become apparent from the following description taken in connection with the accompanying drawings, in which.

DETAILED DESCRIPTION

1. Overall Structure of a Printer

Figure 1:
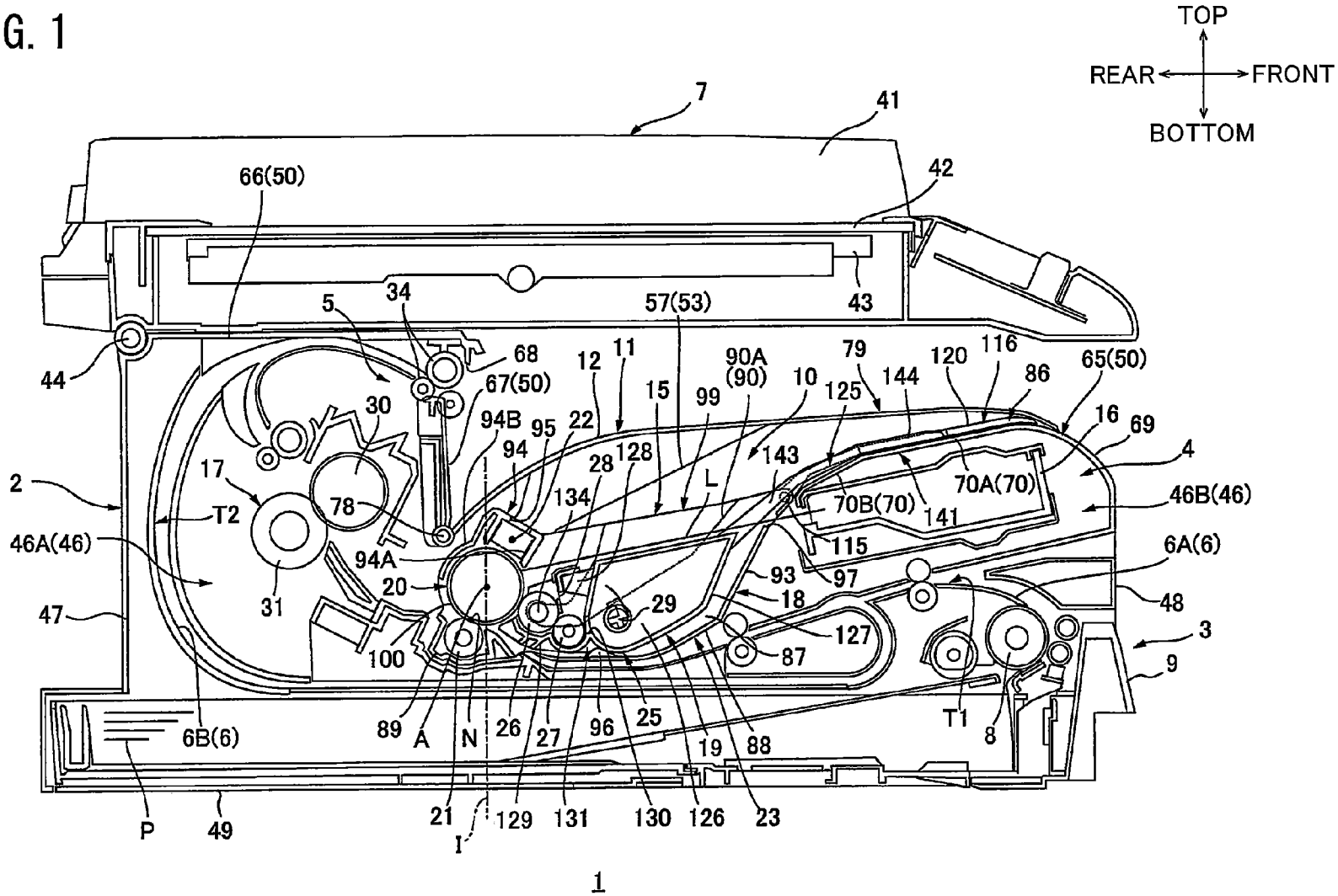
FIG. 1 is a central cross-sectional view of a printer wherein a process cartridge is at an internal position according to a first embodiment.

FIG. 1 shows a printer 1 as an example of an image forming apparatus in a first embodiment. The printer 1 of the first embodiment is a monochromatic printer having an electrophotographic system. The printer 1 includes a main casing 2 as an example of a casing, a sheet-feeding unit 3, an image-forming unit 4, a discharging unit 5, a conveyance guiding unit 6, and a flatbed scanner 7 as an example of an image reading unit.

Directions used in the following description in relation to the printer 1 will reference the state of the printer 1 when the printer 1 is resting on a level surface, where the right side of the printer 1 in FIG. 1 will be called the "front," and the left side of the printer 1 will be called the "rear." Left and right sides of the printer 1 will be defined based on the perspective of a user facing the front side of the printer 1, so that the near side of the printer 1 in FIG. 1 is the "left side," and the far side is the "right side." Further, front, rear, left, right, top, and bottom sides of a process cartridge 15 described later are defined based on the mounted state of the process cartridge 15 in the main casing 2. Directional arrows have also been provided in the drawings for reference.

Note that the left-right direction is an example of a first direction. Similarly, the front-rear direction is an example of a second direction, where the front side is an example of a first side and an example of a third side, and the rear side is an example of a second side and an example of a fourth side. Further, the top-bottom direction is identical to the vertical direction and is an example of a third direction.

The main casing 2 has a box-like shape and includes an access opening 10, and a top cover 11 as an example of a cover.

The access opening 10 penetrates the main casing 2 vertically and provides communication between the interior and the exterior of the main casing 2.

Figure 2:
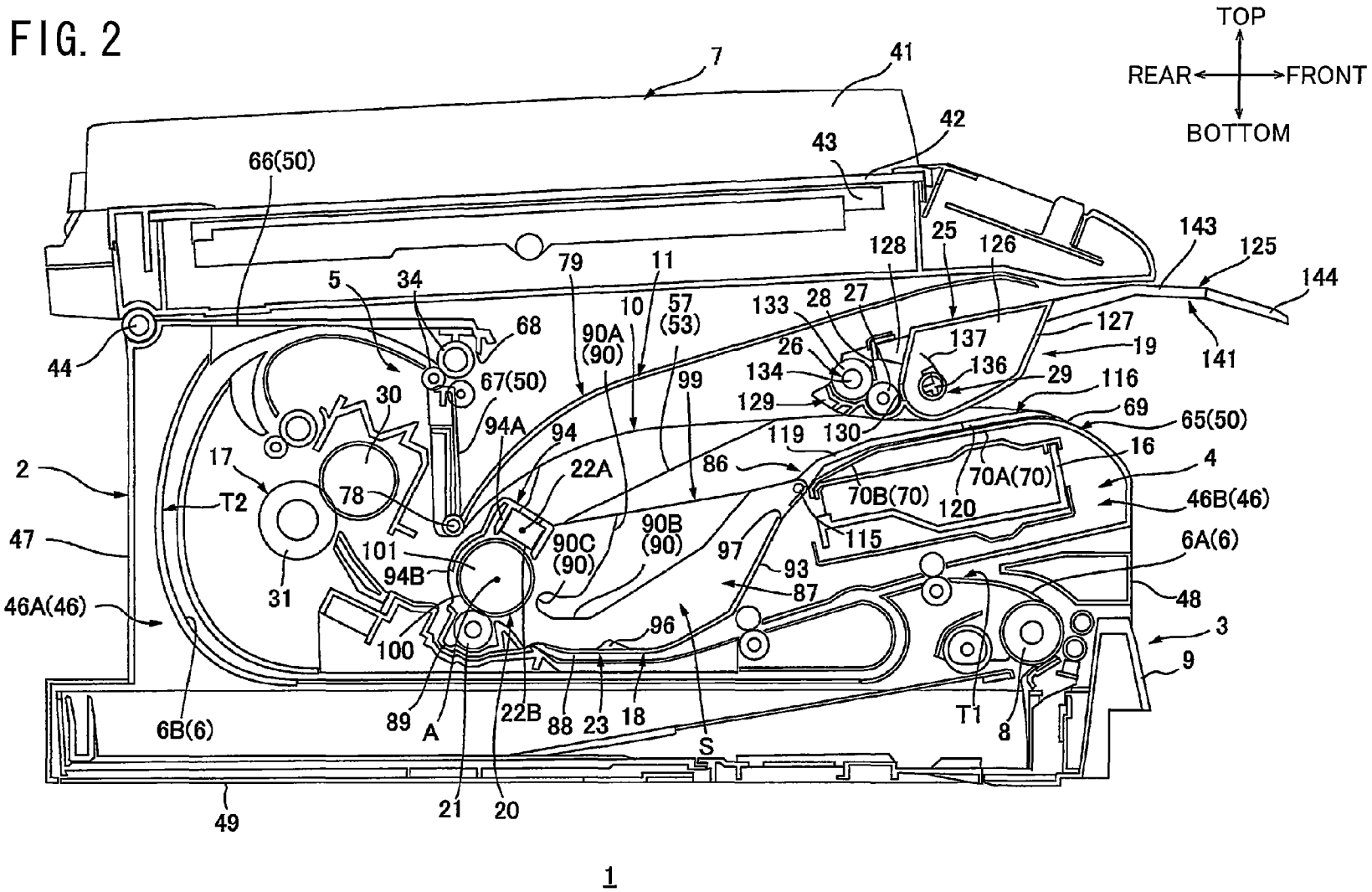
FIG. 2 is a central cross-sectional view of the printer wherein a developing cartridge is being removed from a drum cartridge according to the first embodiment.
Figure 3:
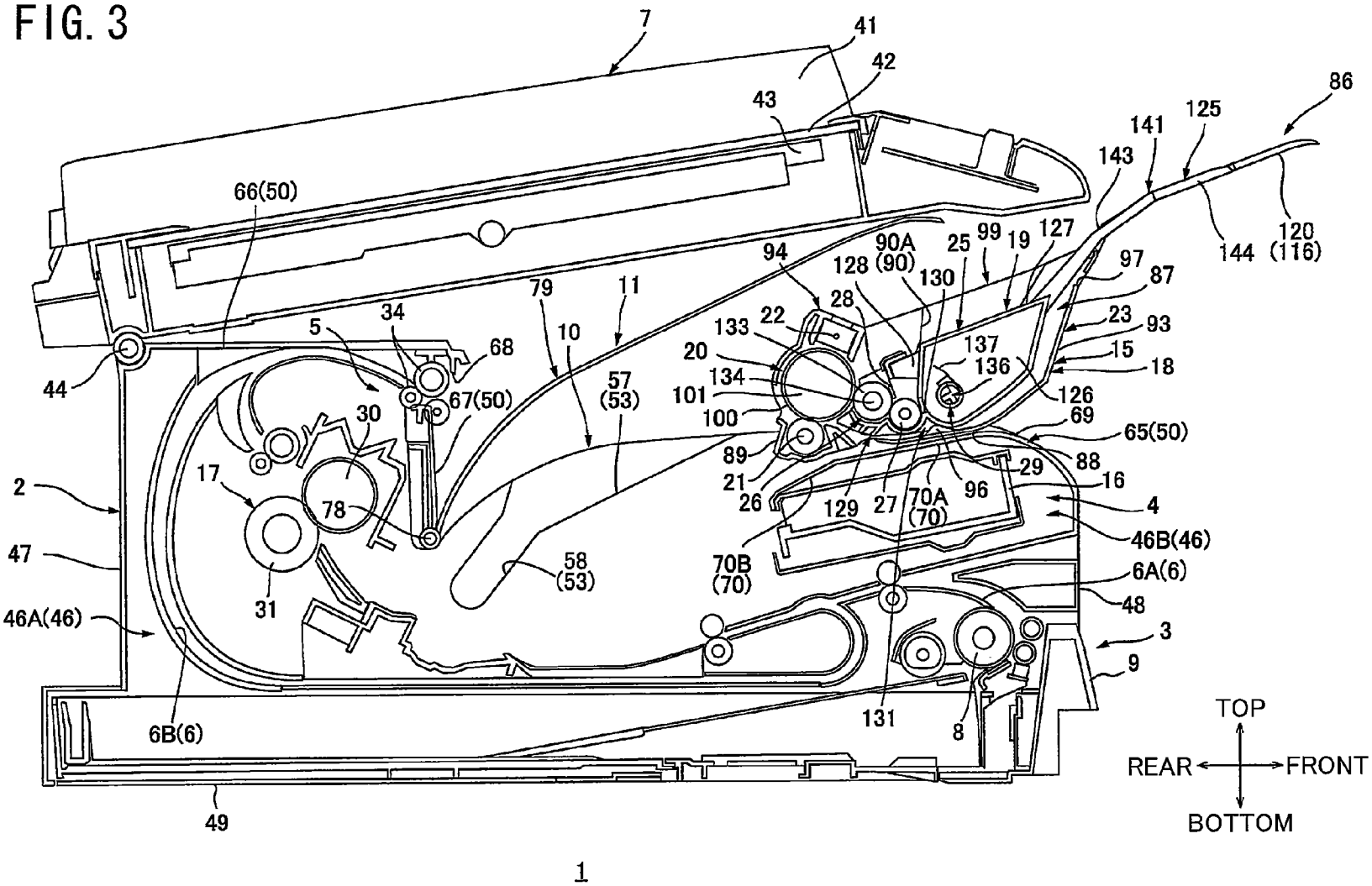
FIG. 3 is a central cross-sectional view of the printer wherein the process cartridge is at an external position according to the first embodiment.

The top cover 11 is pivotally movable between a closed position at which the top cover 11 covers the access opening 10 (FIG. 1), and an open position at which the access opening 10 is exposed (FIGS. 2 and 3). The top cover 11 also functions as a discharge tray 12 configured to support sheets P as an example of a recording medium.

The main casing 2 accommodates therein the sheet-feeding unit 3, the image-forming unit 4, the discharging unit 5, and the conveyance guiding unit 6 and supports the flatbed scanner 7 from below.

The sheet-feeding unit 3 is configured to supply sheets P to the image-forming unit 4. The sheet-feeding unit 3 is provided in the bottom section of the main casing 2. The sheet-feeding unit 3 includes a sheet cassette 9, and a feeding roller 8 as an example of a separating roller.

The sheet cassette 9 has a box-like shape that is open on the top for accommodating a plurality of sheets P. The sheet cassette 9 is provided in the bottom section of the main casing 2 and can be mounted in and removed from the main casing 2.

The feeding roller 8 has a general columnar shape elongated in the left-right direction. The feeding roller 8 is disposed above the front end of the sheet cassette 9.

The image-forming unit 4 is configured to form images on the sheets P. The image-forming unit 4 is disposed above the sheet-feeding unit 3 in the main casing 2. The image-forming unit 4 includes the process cartridge 15, a scanning unit 16 as an example of an exposure unit, and a fixing unit 17.

The process cartridge 15 can be moved between an internal position at which the process cartridge 15 is mounted in the main casing 2 (FIG. 1), and an external position at which the process cartridge 15 is removed from the main casing 2 through the access opening 10 (FIG. 3). Hence, the process cartridge 15 is configured to be mounted in and removed from the main casing 2 through the access opening 10.

As shown in FIG. 1, the process cartridge 15 is disposed in the approximate center of the main casing 2 in a side view, above the approximate front-rear center of the sheet cassette 9 and rearward of the feeding roller 8. In other words, the sheet cassette 9 is disposed below the process cartridge 15, and the feeding roller 8 is disposed forward of the process cartridge 15.

The process cartridge 15 includes a drum cartridge 18 as an example of a photosensitive cartridge, and a developing cartridge 19.

The drum cartridge 18 includes a photosensitive drum 20 as an example of a photosensitive body, a transfer roller 21, and a scorotron charger 22 as an example of a charger.

The photosensitive drum 20 has a general cylindrical shape elongated in the left-right direction. The photosensitive drum 20 is disposed at the rear portion of the drum cartridge 18. The transfer roller 21 is disposed diagonally downward and rearward of the photosensitive drum 20. The upper-front surface of the transfer roller 21 contacts the lower-rear surface of the photosensitive drum 20 at a nipping point N. The scorotron charger 22 is disposed diagonally upward and frontward of the photosensitive drum 20 but is separated therefrom.

The developing cartridge 19 is configured to be mounted in and removed from the drum cartridge 18 at the front side of the photosensitive drum 20. The developing cartridge 19 includes a developing roller 26, a supply roller 27, a thickness-regulating blade 28, and an agitator 29. The developing cartridge 19 also accommodates therein toner as an example of a developing agent.

The developing roller 26 is disposed at the rear portion of the developing cartridge 19. The upper rear portion of the developing roller 26 is exposed outside the developing cartridge 19. The upper-rear surface of the developing roller 26 contacts the lower-front surface of the photosensitive drum 20.

The supply roller 27 is disposed diagonally downward and forward of the developing roller 26. The upper-rear surface of the supply roller 27 contacts the lower-front surface of the developing roller 26.

The thickness-regulating blade 28 has a plate-like structure that is generally rectangular in a rear view and elongated in the left-right direction. The thickness-regulating blade 28 is disposed diagonally upward and forward of the developing roller 26. The lower edge of the thickness-regulating blade 28 contacts the front surface of the developing roller 26.

The agitator 29 is disposed diagonally upward and forward of the supply roller 27.

The scanning unit 16 is disposed forward of the photosensitive drum 20 with a gap therebetween and above the feeding roller 8 with a gap therebetween. More specifically, the scanning unit 16 overlaps the feeding roller 8 as viewed in top-bottom direction, and the scanning unit 16 also overlaps the fixing unit 17 and the process cartridge 15 as viewed in the front-rear direction, when the process cartridge 15 is at the internal position, as shown in FIG. 1. Specifically, at least part of the scanning unit 16 overlaps the process cartridge 15 as viewed in the front-rear direction when the process cartridge 15 is at the internal position. In other word, at least part of the scanning unit 16 overlaps the developing cartridge 19 as viewed in the front-rear direction when the developing cartridge 19 is mounted in the main casing 2.

The scanning unit 16 is configured to expose the photosensitive drum 20. That is, the scanning unit 16 emits a laser beam L toward the photosensitive drum 20 along an irradiating path based on image data, as indicated by a solid line in FIG. 1.

The fixing unit 17 is disposed rearward of the process cartridge 15 with a gap therebetween. The fixing unit 17 includes a heating roller 30, and a pressure roller 31.

The pressure roller 31 is disposed diagonally downward and rearward of the heating roller 30. The upper-front surface of the pressure roller 31 is in pressure contact with the lower-rear surface of the heating roller 30.

The discharging unit 5 is configured to discharge sheets P onto the discharge tray 12 after the image-forming unit 4 has formed an image thereon. The discharging unit 5 includes a pair of discharge rollers 34.

The discharge rollers 34 are disposed diagonally upward and forward of the fixing unit 17 and are separated therefrom. The discharge rollers 34 contact each other in a direction extending from upper front to lower rear.

The conveyance guiding unit 6 is configured to guide conveyance of sheets P within the main casing 2. The conveyance guiding unit 6 has a first conveyance guide 6A, and a second conveyance guide 6B.

After the feeding roller 8 feeds a sheet P from the sheet cassette 9, the first conveyance guide 6A guides the sheet P through the nipping point N between the photosensitive drum 20 and the transfer roller 21 to the pair of discharge rollers 34. Thus, the first conveyance guide 6A defines a conveying path T1 that is general S-shaped in a side view.

The second conveyance guide 6B guides the conveyed sheet P having an image formed on one side from the discharge rollers 34 to a portion of the first conveyance guide 6A on the upstream side of the nipping point N. More specifically, the second conveyance guide 6B is formed continuously with a portion of the first conveyance guide 6A positioned between the fixing unit 17 and the discharge rollers 34, follows a general L-shaped path in a side view that passes between the sheet cassette 9 and the process cartridge 15, and then curves upward to connect to the first conveyance guide 6A at a position between the feeding roller 8 and the nipping point N. Thus, the second conveyance guide 6B defines a re-conveying path T2 that has a general C-shape in a side view, with the opening of the "C" facing upward.

The flatbed scanner 7 is disposed above the main casing 2 and faces the top of the top cover 11 with a gap therebetween. The flatbed scanner 7 includes a shaft 44, a restraining cover 41, a glass surface 42, and a CCD sensor 43.

The shaft 44 is provided on the lower-rear portion of the flatbed scanner 7. The shaft 44 has a general columnar shape and extends in the left-right direction. The shaft 44 is rotatably supported in the upper-rear portion of the main casing 2, whereby the flatbed scanner 7 is pivotally movable relative to the main casing 2 about the shaft 44.

The flatbed scanner 7 is configured to read image data from a document by the CCD sensor 43 after the document has been placed on the glass surface 42 and covered with the restraining cover 41.

2. Detailed Description of the Main Casing

As shown in FIG. 3, the main casing 2 is integrally configured of a pair of side walls 46, a rear wall 47, a bottom wall 49, a front wall 48, and a top wall 50. The main casing 2 also includes a motor (not shown), an apparatus-side coupling (not shown), and the top cover 11 described above.

The side walls 46 constitute the left and right sides of the main casing 2 and are away from each other in the left-right direction. The side walls 46 have a plate-like structure that is generally L-shaped in a side view. Specifically, each side wall 46 is configured of a rear portion 46A that has a general rectangular shape in a side view and is elongated top-bottom direction, and a front portion 46B that has a general rectangular shape in a side view and is elongated in the front-rear direction. The front portion 46B extends forward from the lower front portion of the rear portion 46A. Each side wall 46 is formed with a groove 53.

The grooves 53 are formed on the inner left-right surfaces of the corresponding side walls 46 in the front portion 46B and are aligned with each other in the left-right direction. That is, the grooves 53 are recessed outward in the left-right direction from the inner left-right surfaces of the corresponding front portions 46B constituting the side walls 46. The grooves 53 extend diagonally downward and rearward from the top edges of the rear end portions of the corresponding front portions 46B. Each groove 53 has a wide section 57, and a narrow section 58.

The wide section 57 constitutes the upper portion of the groove 53 and is formed to gradually narrow toward the lower rear end thereof. The narrow section 58 constitutes the lower portion of the groove 53 and extends continuously downward and rearward from the lower rear end of the wide section 57. The width of the narrow section 58 is uniform. The lower-rear end of the narrow section 58 has a general semicircular shape in a side view, with the concave of the narrow section 58 facing diagonally upward and forward.

An apparatus-side coupling is disposed at the bottom end of the narrow section 58 of the left-side groove 53. The apparatus-side coupling is an interlocking mechanism well known in the art that is configured to move left and right in association with the opening and closing operation of the top cover 11. When the top cover 11 is at the open position, the apparatus-side coupling is retracted further leftward from the right surface of the left side wall 46. When the top cover 11 is at the closed position, the apparatus-side coupling is advanced to a position further rightward than the right surface of the left side wall 46. The apparatus-side coupling is configured to transmit a drive force from the motor and rotates clockwise in a left side view when transmitting the drive force.

The rear wall 47 constitutes the rear portion of the main casing 2. The rear wall 47 has a plate-like structure that is generally rectangular in a rear side view and is elongated in the left-right direction. The left and right edges of the rear wall 47 are formed continuously with the rear edges of the respective side walls 46.

The bottom wall 49 constitutes the bottom portion of the main casing 2. The bottom wall 49 has a plate-like structure and is generally rectangular in a bottom view. The left and right edges of the bottom wall 49 are formed continuously with the bottom edges of the corresponding side walls 46, and the rear edge of the bottom wall 49 is formed continuously with the bottom edge of the rear wall 47.

The front wall 48 constitutes the front portion of the main casing 2. The front wall 48 has a plate-like structure that is generally rectangular in a front view and elongated in the left-right direction. The left and right edges of the front wall 48 are formed continuously with the front edges of the respective side walls 46.

The top wall 50 constitutes the top portion of the main casing 2. The top wall 50 includes a first wall section 65, a second wall section 66, and a third wall section 67.

The first wall section 65 constitutes the front portion of the top wall 50 and is positioned above the scanning unit 16 so as to cover the same. The first wall section 65 extends continuously rearward from the top edge of the front wall 48 and is elongated in the left-right direction. The left and right edges of the first wall section 65 are formed continuously with the upper front portions of the respective side walls 46.

More specifically, the first wall section 65 integrally possesses a curved wall 69, and a sloped wall 70.

The curved wall 69 constitutes the front portion of the first wall section 65. The curved wall 69 extends continuously upward from the top edge of the front wall 48 so as to curve toward the rear.

The sloped wall 70 constitutes the rear portion of the first wall section 65. The sloped wall 70 integrally possesses a first sloped section 70A, and a second sloped section 70B.

The first sloped section 70A extends continuously rearward from the top edge of the curved wall 69 and slops downward. The second sloped section 70B forms a bend from the rear edge of the first sloped section 70A and slopes downward toward the rear. The second sloped section 70B has a steeper downward slope than the first sloped section 70A.

The second wall section 66 constitutes the rear portion of the top wall 50. The second wall section 66 is disposed above the discharging unit 5 and is positioned higher than the first wall section 65. The second wall section 66 extends continuously forward from the top edge of the rear wall 47 and is elongated in the left-right direction. The left and right edges of the second wall section 66 are formed continuously with the top edges of the respective rear portions 46A of the side walls 46.

As shown in FIG. 1, the second wall section 66 contacts the lower rear portion of the flatbed scanner 7 to support the flatbed scanner 7. The shaft 44 of the flatbed scanner 7 is rotatably supported at the corner of the second wall section 66 and the rear wall 47.

The third wall section 67 bends and extends downward from the front edge of the second wall section 66. The third wall section 67 is elongated in the left-right direction. The left and right edges of the third wall section 67 are formed continuously with the upper front edges of the rear portions 46A of the side walls 46. The third wall section 67 is formed with a discharge opening 68.

The discharge opening 68 is formed at the top region of the third wall section 67 in front of the discharge rollers 34. The discharge opening 68 penetrates the top edge of the third wall section 67 in the front-rear direction and has a size and shape for allowing passage of sheets P.

The access opening 10 is defined by the rear edge of the sloped wall 70, the bottom edge of the third wall section 67, and the parts of the front portions 46B of the side walls 46 that are positioned between the sloped wall 70 and the third wall section 67. Hence, the access opening 10 is formed at the rear of the scanning unit 16 and above the process cartridge 15 when the process cartridge 15 is mounted in the main casing 2. The access opening 10 has a general rectangular shape in a plan view and provides vertical communication between the interior and the exterior of the main casing 2.

As described above, the top wall 50 supports the top cover 11 provided for opening and closing the access opening 10.

The top cover 11 includes a rotational shaft 78 as an example of a pivot shaft, and a cover body 79.

The rotational shaft 78 has a general columnar shape elongated in the left-right direction. The rotational shaft 78 is rotatably supported on the bottom end of the third wall section 67, i.e., the rear peripheral edge of the access opening 10. Accordingly, the rotational shaft 78 is disposed diagonally upward and rearward of the process cartridge 15 when the process cartridge 15 is at the internal position. More specifically, the rotational shaft 78 is disposed between the scorotron charger 22 and the fixing unit 17 in the front-rear direction.

The cover body 79 has a plate-like structure that is generally rectangular in a plan view.

The cover body 79 of the top cover 11 is pivotally movable about the rotational shaft 78 between the closed position shown in FIG. 1 at which the top cover 11 covers the access opening 10, and the open position shown in FIG. 3 at which the access opening 10 is exposed.

When the top cover 11 is at the closed position shown in FIG. 1, the cover body 79 extends diagonally upward and forward from the rotational shaft 78, and then curves and extends forward. The front end of the cover body 79 is positioned above the area at which the rear edge of the curved wall 69 connects with the first sloped section 70A. In this way, the cover body 79 is positioned above the process cartridge 15 mounted in the main casing 2. Further, the rotational shaft 78 is disposed at the lowest end of the top cover 11.

However, when the top cover 11 is at the open position shown in FIG. 3, the cover body 79 extends diagonally upward and forward from the rotational shaft 78, and then curves and continues extending diagonally upward and forward at a gentler upward slope. The front edge of the cover body 79 is disposed high enough above the sloped wall 70 to form space allowing the process cartridge 15 to pass therethrough.

3. Detailed Description of the Process Cartridge

As described above, the process cartridge 15 includes the drum cartridge 18 and the developing cartridge 19.

(1) Drum Cartridge

Figure 5A:
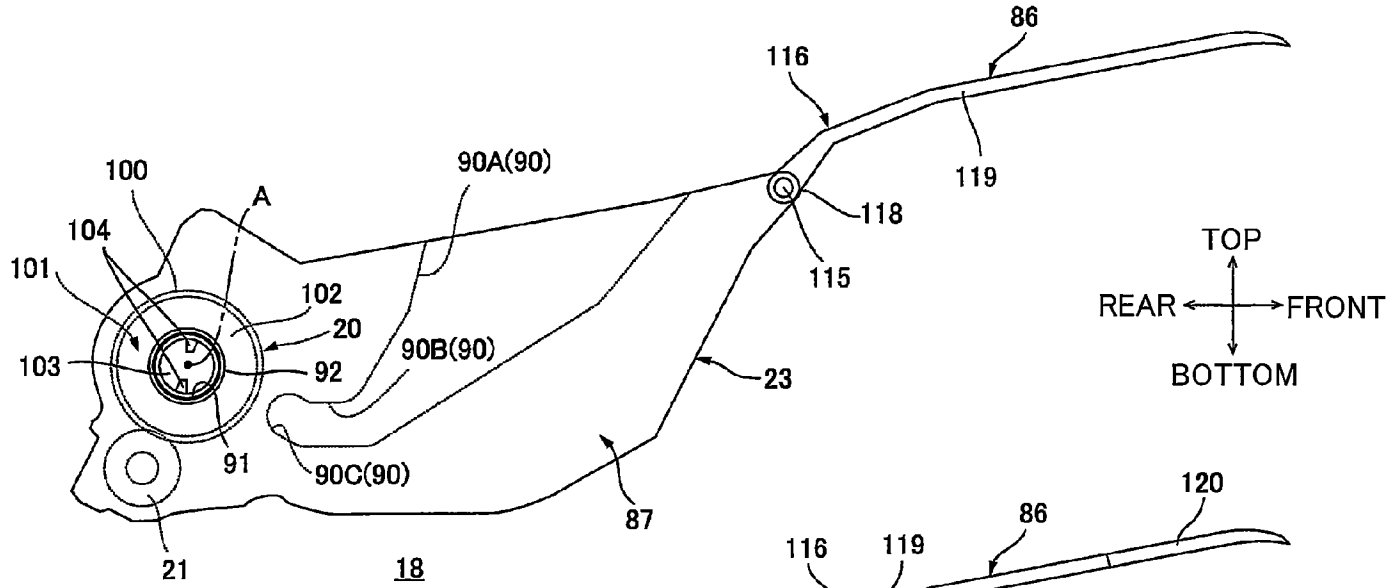
FIG. 5A is a left side view of the drum cartridge according to the first embodiment.
Figure 5B:
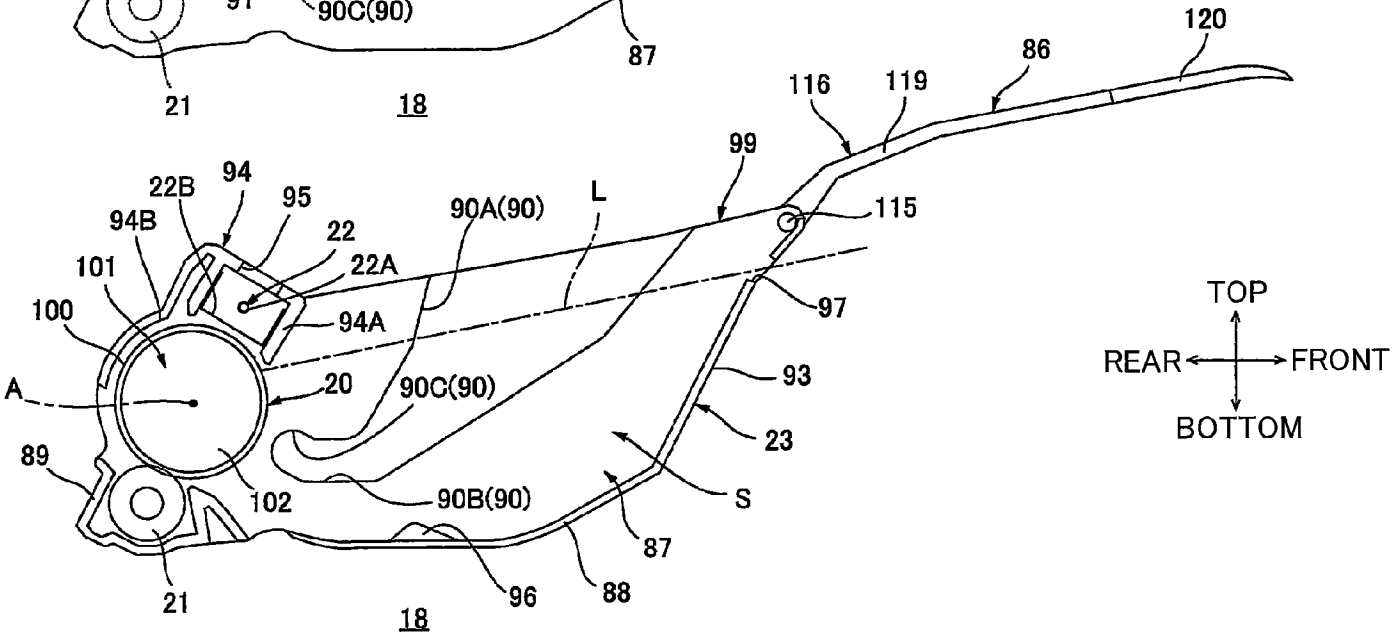
FIG. 5B is a cross-sectional view of the drum cartridge according to the first embodiment.

As shown in FIGS. 5A and 5B, the drum cartridge 18 includes a drum-cartridge frame 23, and a drum-cartridge handle 86 as an example of a grip unit.

The drum-cartridge frame 23 has a box-like shape that is open on the top. The drum-cartridge frame 23 is integrally configured of a pair of side walls 87, a bottom wall 88, a front wall 93, a transfer-roller accommodating section 89, and a charger support wall 94.

The side walls 87 constitute the left and right end portions of the drum-cartridge frame 23 and oppose but are separated from each other in the left-right direction. The side walls 87 have a plate-like structure that is generally rectangular in a side view and elongated in the front-rear direction. Each of the side walls 87 includes a receiving groove 90, a through-hole 91, and a collar 92.

The receiving groove 90 is formed in the inner left-right surface of the corresponding side wall 87. The receiving groove 90 is recessed outward in the left-right direction from the inner left-right surface of the corresponding side wall 87 and extends diagonally downward and rearward from the top edge of the side wall 87. Specifically, the receiving groove 90 includes a guide part 90A, an intermediate part 90B, and an end part 90C.

The guide part 90A constitutes the upper portion of the receiving groove 90. The guide part 90A extends diagonally downward and rearward from the approximate front-rear center region of the top edge of the side wall 87. The guide part 90A becomes narrower toward the lower-rear end thereof.

The intermediate part 90B extends continuously rearward from the bottom end of the guide part 90A.

The end part 90C curves continuously upward and rearward from the rear end of the intermediate part 90B. The rear end of the end part 90C has a general semicircular shape in a side view. The concave of the end part 90C faces diagonally downward and forward.

As shown in FIG. 5A, the through-hole 91 is formed at the rear portion of the corresponding side wall 87 at a position diagonally upward and rearward of the end part 90C of the corresponding receiving groove 90 and separated therefrom. The through-hole 91 has a general circular shape in a side view and penetrates the side wall 87 in the left-right direction.

The collar 92 is disposed on the outer left-right surface of the corresponding side wall 87 and is configured to be inserted into the corresponding groove 53. The collar 92 has a general cylindrical shape elongated in the left-right direction. The collar 92 protrudes outward in the left-right direction from the peripheral edge of the corresponding side wall 87 defining the corresponding through-hole 91. The outer diameter of the collar 92 is approximately equal to the width of the narrow section 58.

As shown in FIG. 5B, the bottom wall 88 bridges the lower front edges of the side walls 87. The bottom wall 88 has a plate-like structure with a general rectangular shape in a bottom view and is elongated in the left-right direction. The bottom wall 88 includes a pair of protruding parts 96.

Figure 4:
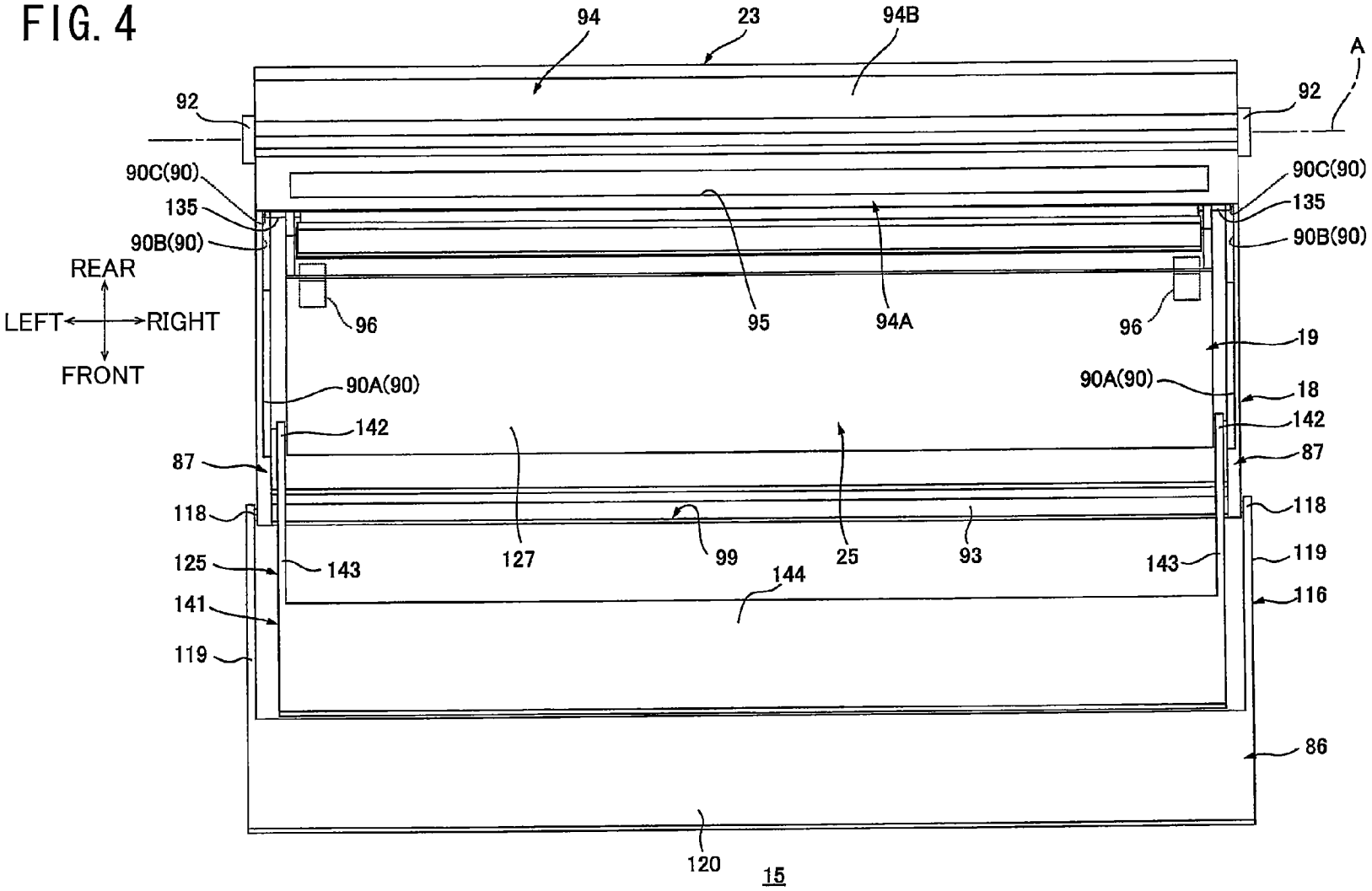
FIG. 4 is a plan view of the process cartridge according to the first embodiment.

As shown in FIGS. 4 and 5B, the protruding parts 96 are disposed on the top surface of the bottom wall 88 in the approximate front-rear center region thereof and are separated from each other in the left-right direction. As shown in FIG. 5B, the protruding parts 96 have a general triangular shape in a side view and protrude upward from the bottom wall 88.

The front wall 93 bridges the front end portions of the side walls 87. The bottom edge of the front wall 93 is connected to the front edge of the bottom wall 88. The front wall 93 has a plate-like structure that is generally rectangular in a front view and elongated in the left-right direction. The front wall 93 is formed with a through-hole 97 as an example of an opening.

The through-hole 97 is formed at the top portion of the front wall 93 and penetrates the front wall 93 in the front-rear direction. The through-hole 97 has a size and shape to allow passage of the laser beam L emitted from the scanning unit 16.

The transfer-roller accommodating section 89 constitutes the lower rear end portion of the drum-cartridge frame 23 and is provided at the rear of the bottom wall 88 with a gap therebetween. The transfer-roller accommodating section 89 has a general U-shape in a side view, with the opening of the "U" facing upward and is elongated in the left-right direction. The left and right ends of the transfer-roller accommodating section 89 are formed continuously with the lower rear end portions of the side walls 87.

The charger support wall 94 constitutes the upper-rear portion of the drum-cartridge frame 23 and is disposed above and separated from the transfer-roller accommodating section 89. The charger support wall 94 is elongated in the left-right direction. The left and right ends of the charger support wall 94 are formed continuously with the upper-rear end portions of the corresponding side walls 87. The charger support wall 94 is integrally configured of a body 94A, and a cover part 94B.

The body 94A has a squared U-shape in a side view, with the opening of the "U" facing diagonally downward and rearward. The body 94A is formed with an opening 95 at the top wall thereof. As shown in FIG. 4, the opening 95 has a general rectangular shape in a plan view and is elongated in the left-right direction. As shown in FIG. 5B, the opening 95 penetrates the top wall of the body 94A in a direction extending from upper front to lower rear.

The cover part 94B has a plate-like structure with a general rectangular shape in a rear view and is elongated in the left-right direction. The cover part 94B extends continuously downward and rearward from the lower-rear edge of the body 94A, and then curves to follow the surface of the photosensitive drum 20.

A cartridge-mounting opening 99 is defined by the top edges of the side walls 87, the top edge of the front wall 93, and the front edge of the charger support wall 94. The cartridge-mounting opening 99 has a general rectangular shape in a plan view and has a size sufficient for allowing passage of the developing cartridge 19.

The side walls 87, the bottom wall 88, and the front wall 93 further define an accommodating space S at the front side of the photosensitive drum 20 for accommodating therein the developing cartridge 19. The accommodating space S is in vertical communication with the cartridge-mounting opening 99.

The drum-cartridge frame 23 also supports the photosensitive drum 20, the transfer roller 21, and the scorotron charger 22.

The photosensitive drum 20 is disposed at the rear end portions of the side walls 87 at a position diagonally upward and forward of the transfer-roller accommodating section 89 and downward and rearward of the charger support wall 94. The photosensitive drum 20 includes a drum body 100, and a pair of flange parts 101.

The drum body 100 includes a metal tube having a general cylindrical shape that is elongated in the left-right direction, and a photosensitive layer that coats the circumferential surface of the metal tube.

The flange parts 101 are fitted into respective left and right ends of the drum body 100. As shown in FIGS. 5A and 5B, each flange part 101 is integrally configured of a fitting part 102, and an insertion part 103.

The fitting part 102 constitutes the inner portion of the flange part 101 in the left-right direction. The fitting part 102 has a general cylindrical shape elongated in the left-right direction. The outer endface of each fitting part 102 in the left-right direction is closed. The outer diameter of the fitting part 102 is approximately equal to the inner diameter of the drum body 100. The fitting part 102 is nonrotatably fitted into the corresponding axial end portion of the drum body 100 in the left-right direction.

The insertion part 103 constitutes the outer portion of the flange part 101 in the left-right direction. The insertion part 103 has a general cylindrical shape that shares the central axis with the fitting part 102 and protrudes outward in the left-right direction from the outer end of the corresponding fitting part 102 in the left-right direction. The outer diameter of the insertion part 103 is smaller than the outer diameter of the fitting part 102 and approximately equal to the inner diameter of the through-hole 91.

As shown in FIG. 5A, the insertion part 103 of the left flange part 101 is configured to be connectable with insertion of the right end of the apparatus-side coupling. The insertion part 103 of the left flange part 101 is integrally provided with a pair of engaging protrusions 104. The engaging protrusions 104 are provided on the inner circumferential surface of the insertion part 103 at an interval of 180 degrees in the circumferential direction of the insertion part 103. The engaging protrusions 104 have a general rectangular shape in a side view and protrude radially inward from the inner circumferential surface of the insertion part 103.

By inserting the insertion part 103 of each flange part 101 into the corresponding through-hole 91 and the collar 92, the photosensitive drum 20 is rotatably supported in the drum-cartridge frame 23 about the rotational axis A of the drum body 100.

As shown in FIG. 5B, the transfer roller 21 is disposed inside the transfer-roller accommodating section 89. The transfer roller 21 has a general columnar shape elongated in the left-right direction. The transfer roller 21 is rotatably supported in the drum-cartridge frame 23 with left and right ends supported in the corresponding side walls 87. The upper-front surface of the transfer roller 21 contacts the lower-rear surface of the drum body 100 of the photosensitive drum 20.

The scorotron charger 22 is supported in the charger support wall 94. The scorotron charger 22 includes a discharge wire 22A, and a grid electrode 22B.

The discharge wire 22A is disposed inside the body 94A in the approximate center region thereof in a side view, and is stretched taut along the left-right direction. The discharge wire 22A is disposed diagonally upward and forward of the photosensitive drum 20 with a gap therebetween. The grid electrode 22B has a general squared U-shape in a side view, with the opening of the "U" facing diagonally upward and forward. The grid electrode 22B is disposed inside the body 94A so as to surround the discharge wire 22A from the lower-rear side. With this construction, the lower-rear side of the grid electrode 22B is positioned between the discharge wire 22A and the drum body 100.

The drum-cartridge handle 86 is provided at the front end portion of the drum cartridge 18. The drum-cartridge handle 86 has a pair of pivoting shafts 115, and a handle body 116.

The pivoting shafts 115 are spaced apart from each other in the left-right direction. The pivoting shafts 115 have a general columnar shape elongated in the left-right direction. The inner portions of the pivoting shafts 115 in the left-right direction are supported on the upper-front corners of the corresponding side walls 87 so as to be incapable of rotating relative to the corresponding side walls 87. The outer portions of the pivoting shafts 115 in the left-right direction protrude farther outward in the left-right direction than the corresponding side walls 87.

As shown in FIG. 4, the handle body 116 has a general U-shape in a plan view, with the opening of the "U" facing rearward. The handle body 116 is integrally configured of a pair of cylindrical parts 118, a pair of coupling parts 119, and a grip part 120 as an example of a grip and an example of a first grip.

As shown in FIGS. 4 and 5A, the cylindrical parts 118 are separated from each other in the left-right direction and positioned to correspond to the respective pivoting shafts 115. The cylindrical parts 118 have a general cylindrical shape elongated in the left-right direction. The inner diameter of the cylindrical parts 118 is approximately equal to the outer diameter of the pivoting shafts 115.

The coupling parts 119 have a rod-like structure extending in a direction from lower rear to upper front. The coupling parts 119 extend continuously upward and forward from the corresponding cylindrical parts 118.

As shown in FIG. 4, the grip part 120 bridges the front end portions of the coupling parts 119. The grip part 120 has a plate-like structure that is generally rectangular in a plan view and elongated in the left-right direction.

As shown in FIGS. 4 and 5A, the outer portions of the pivoting shafts 115 in the left-right direction is rotatably inserted into the corresponding cylindrical parts 118. Thus, the drum-cartridge handle 86 is supported on the drum-cartridge frame 23. With this configuration, the grip part 120 is pivotally movable about the pivoting shafts 115 relative to the drum-cartridge frame 23.

(2) Developing Cartridge

Figure 6A:
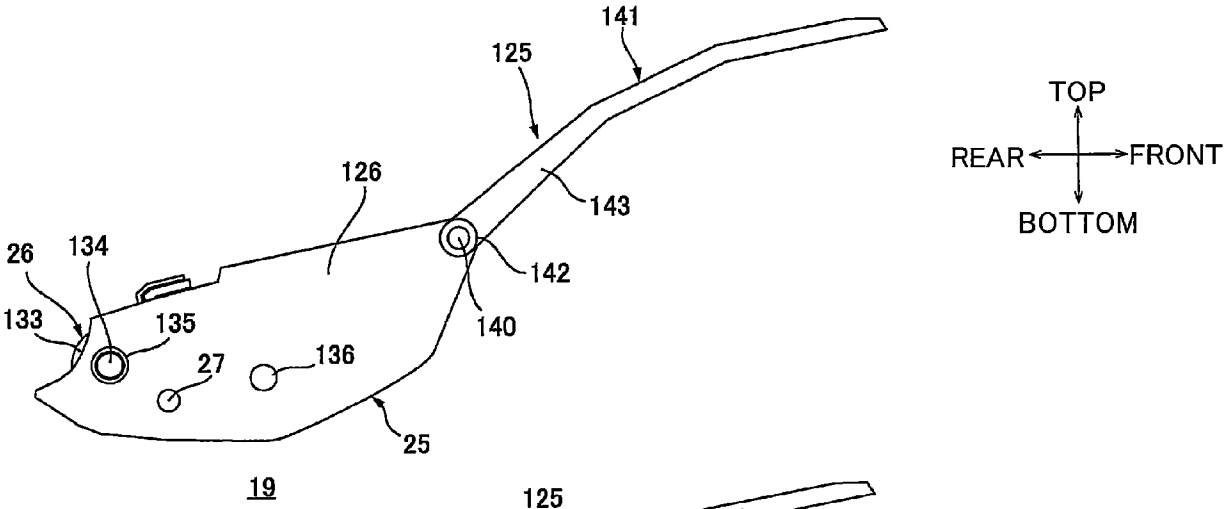
FIG. 6A is a left side view of the developing cartridge according to the first embodiment.
Figure 6B:
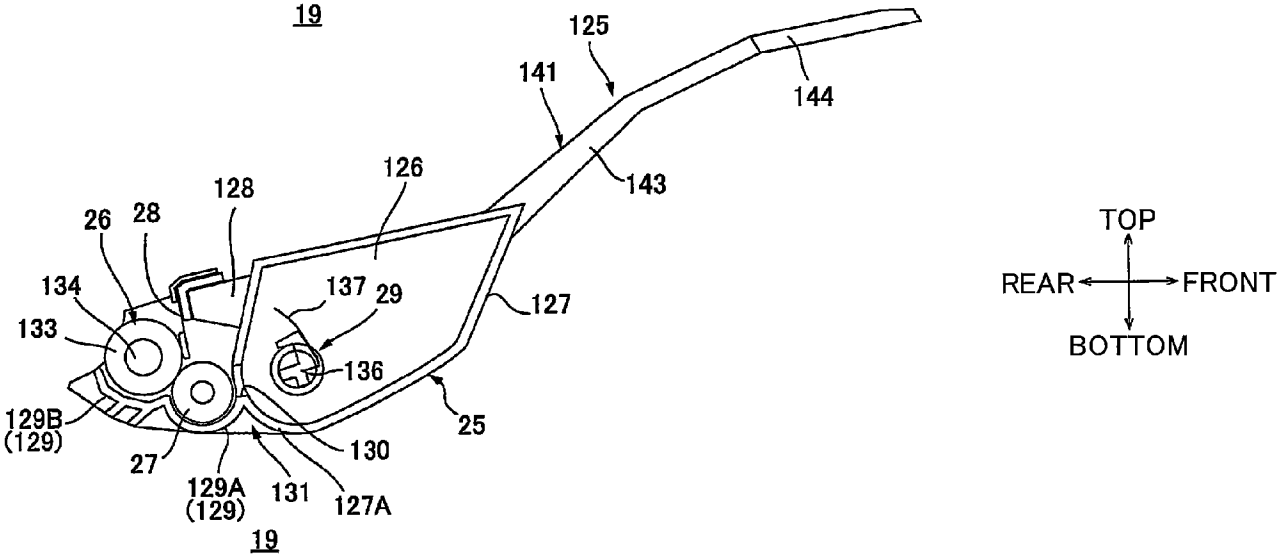
FIG. 6B is a cross-sectional view of the developing cartridge according to the first embodiment.

As shown in FIGS. 6A and 6B, the developing cartridge 19 includes a developing-cartridge frame 25, and a developing-cartridge handle 125 as an example of a grip unit.

The developing-cartridge frame 25 is integrally configured of a pair of side walls 126, a toner accommodating section 127, a blade support part 128, and a bottom wall 129.

The side walls 126 constitute the left and right portions of the developing-cartridge frame 25 and oppose each other in the left-right direction with a gap therebetween. As shown in FIG. 6A, the side walls 126 have a plate-like structure with a general rectangular shape in a side view and are elongated in the front-rear direction.

As shown in FIG. 6B, the toner accommodating section 127 is disposed between the front portions of the side walls 126. The toner accommodating section 127 has a general angular cylindrical shape elongated in the left-right direction. The toner accommodating section 127 has a bottom wall 127A that curves in a side view with the convex facing downward. The left and right ends of the toner accommodating section 127 are closed by the front portions of the side walls 126. The toner accommodating section 127 accommodates toner therein.

The toner accommodating section 127 is formed with a through-hole 130. The through-hole 130 is formed at the front wall of the toner accommodating section 127 near the bottom end thereof and penetrates the front wall in the front-rear direction.

The blade support part 128 is disposed at the upper portion on the front surface of the front wall of the toner accommodating section 127. The blade support part 128 has a general rectangular shape in a side view and protrudes forward from the toner accommodating section 127.

The bottom wall 129 extends rearward from the bottom peripheral edge of the through-hole 130 in the toner accommodating section 127. The bottom wall 129 is elongated in the left-right direction. The left and right ends of the bottom wall 129 are connected to the bottom edges of the side walls 126 at the rear portions of the bottom wall 129.

More specifically, the bottom wall 129 includes an arc-shaped part 129A, and a lip part 129B.

The arc-shaped part 129A constitutes the front portion of the bottom wall 129. The arc-shaped part 129A has a general semicircular shape in a side view, and the concave portion of the arc-shaped part 129A faces upward so as to follow the circumferential surface of the supply roller 27. The front edge of the arc-shaped part 129A is connected to the rear edge of the bottom wall 127A of the toner accommodating section 127.

The bottom surfaces of the arc-shaped part 129A and the bottom wall 127A of the toner accommodating section 127 define a recessed part 131 at the front portion of the arc-shaped part 129A and at the rear portion of the bottom wall 127A. The recessed part 131 has a general triangular shape in a side view and forms an upward recess from the bottom surface of the developing-cartridge frame 25.

The lip part 129B constitutes the rear portion of the bottom wall 129. The lip part 129B has a general arc shape in a side view, and the concave portion of the lip part 129B faces diagonally upward and forward so as to follow the circumferential surface of the developing roller 26. The front edge of the lip part 129B is connected to the rear edge of the arc-shaped part 129A.

The developing-cartridge frame 25 supports the developing roller 26, the supply roller 27, the thickness-regulating blade 28, and the agitator 29.

The developing roller 26 is disposed above the lip part 129B with a gap therebetween. As shown in FIGS. 6A and 6B, the developing roller 26 includes a roller shaft 134, a roller body 133, and a pair of cylinders 135.

The roller shaft 134 has a general columnar shape elongated in the left-right direction. The left-right dimension of the roller shaft 134 is greater than the left-right dimension of the developing-cartridge frame 25. The left and right ends of the roller shaft 134 are rotatably supported on the corresponding side walls 126, thereby rotatably supporting the developing roller 26 in the developing-cartridge frame 25. The left and right ends of the roller shaft 134 protrude outward in the left-right direction from the corresponding side walls 126.

The roller body 133 has a general cylindrical shape elongated in the left-right direction. The left-right dimension of the roller body 133 is smaller than the left-right dimension of the roller shaft 134. The roller body 133 covers the roller shaft 134 and is disposed at a position between the rear end portions of the side walls 126.

One of the cylinders 135 is provided on each of the left and right ends of the roller shaft 134 and disposed at the outer side of the corresponding side wall 126 in the left-right direction. The cylinders 135 have a general cylindrical shape elongated in the left-right direction. The inner diameter of the cylinders 135 is approximately equal to the outer diameter of the roller shaft 134, while the outer diameter of the cylinders 135 is approximately equal to the width of the intermediate parts 90B and end parts 90C of the receiving grooves 90. The cylinders 135 are fitted over the left and right end portions of the roller shaft 134 in the outer sides of the side walls 126 in the left-right direction so as to be rotatable relative to the roller shaft 134.

As shown in FIG. 6B, the supply roller 27 is disposed inside the arc-shaped part 129A at the lower-front side of the developing roller 26. The supply roller 27 has a general columnar shape elongated in the left-right direction. The supply roller 27 is supported in the developing-cartridge frame 25 with its left and right ends rotatably supported in the corresponding side walls 126.

The thickness-regulating blade 28 is fixed to the rear surface of the blade support part 128. The bottom edge of the thickness-regulating blade 28 contacts the front surface of the roller body 133.

The agitator 29 is disposed in the toner accommodating section 127. The agitator 29 includes an agitator shaft 136, and an agitating blade 137.

The agitator shaft 136 has a general columnar shape elongated in the left-right direction. The agitating blade 137 is formed of a flexible film material and extends radially outward from the agitator shaft 136.

The agitator 29 is supported on the developing-cartridge frame 25 with the left and right ends of the agitator shaft 136 rotatably supported in the corresponding side walls 126.

As shown in FIGS. 6A and 6B, the developing-cartridge handle 125 is provided at the front end portion of the developing cartridge 19. The developing-cartridge handle 125 includes a pair of pivoting shafts 140, and a handle body 141.

The pivoting shafts 140 are separated from each other in the left-right direction. The pivoting shafts 140 have a general columnar shape elongated in the left-right direction. The inner portions of the pivoting shafts 140 in the left-right direction are non-rotatably supported on the upper-front corners of the corresponding side walls 126. Thus, the outer portions of the pivoting shafts 140 in the left-right direction protrude outward in the left-right direction from the corresponding side walls 126.

As shown in FIG. 4, the handle body 141 has a general U-shape in a plan view with the opening of the "U" facing rearward. The left-right dimension of the handle body 141 is smaller than the left-right distance between the pair of coupling parts 119 of the handle body 116. As shown in FIG. 6A, the handle body 141 includes a pair of cylindrical parts 142, a pair of coupling parts 143, and a grip part 144 as an example of a grip and an example of a second grip. Hence, the process cartridge 15 includes the grip part 120 and the grip part 144 as grips.

The cylindrical parts 142 are separated from each other in the left-right direction and disposed at positions corresponding to the pivoting shafts 140. The cylindrical parts 142 have a general cylindrical shape elongated in the left-right direction. The inner diameter of the cylindrical parts 142 is approximately equal to the outer diameter of the pivoting shafts 140.

The coupling parts 143 are rod-like members extending in a direction from lower rear to upper front. Specifically, the coupling parts 143 extend continuously upward and forward from the corresponding cylindrical parts 142.

As shown in FIG. 4, the grip part 144 bridges the top ends of the coupling parts 143. The grip part 144 has a plate-like structure that is generally rectangular in a plan view and elongated in the left-right direction.

As shown in FIG. 6A, the developing-cartridge handle 125 is supported on the developing-cartridge frame 25 by rotatably inserting the outer portions of the pivoting shafts 140 in the left-right direction into the corresponding cylindrical parts 142. With this arrangement, the developing-cartridge handle 125 is pivotally movable about the pivoting shafts 140 relative to the developing cartridge frame 25.

The developing cartridge 19 having the above construction is configured to be mounted in and removed from the accommodating space S formed in the drum cartridge 18, as shown in FIG. 1, thereby configuring the process cartridge 15. When the developing cartridge 19 is mounted in the drum cartridge 18, the cylinders 135 are inserted into the end parts 90C of the corresponding receiving grooves 90. Further, the recessed part 131 of the developing-cartridge frame 25 receives the pair of protruding parts 96 such that the bottom wall 127A of the toner accommodating section 127 contacts the upper-front surfaces of the protruding parts 96.

(3) Mounting the Process Cartridge in the Main Casing

When the process cartridge 15 is in the mounted state in the main casing 2, i.e., is at the internal position, the grip part 120 of the drum-cartridge handle 86 is disposed at the front region of the top surface of the first sloped section 70A, and the grip part 144 of the developing-cartridge handle 125 is disposed at the rear region of the top surface of the first sloped section 70A.

Accordingly, at least part of the grip part 120 and at least part of the grip part 144 are disposed above the scanning unit 16 so as to overlap the scanning unit 16 vertically. Hence, the grip part 120 and the grip part 144 are positioned above the irradiating path of the laser beam L. The grip part 120 and the grip part 144 are disposed along the first sloped section 70A, i.e., are rest on the first sloped section 70A.

Further, the front portion of the cover body 79 of the top cover 11 covers the grip part 120 and the pivoting shafts 140 from above.

As shown in FIG. 4, the grip part 144 is arranged adjacent to the rear side of the grip part 120 and is surrounded by the handle body 116.

In addition, the coupling parts 143 of the developing-cartridge handle 125 are positioned outside the irradiating path of the laser beam L in the left-right direction, and the coupling parts 119 of the drum-cartridge handle 86 are positioned outside the coupling parts 143 of the developing-cartridge handle 125 in the left-right direction.

Further, the developing cartridge 19 is disposed such that the developing-cartridge frame 25 is positioned below the irradiating path of the laser beam L, as shown in FIG. 1. The developing roller 26 is disposed below the irradiating path of the laser beam L.

While not shown in the drawings, the collars 92 of the drum cartridge 18 are inserted into the bottom ends of the corresponding narrow sections 58 of the grooves 53. Further, the apparatus-side coupling is advanced rightward and inserted into the insertion part 103 of the left flange part 101 and engaged with the pair of engaging protrusions 104.

4. Image-Forming Operation (1) Developing Operation

When the printer 1 described above begins an image-forming operation under control of a control unit (not shown), the scorotron charger 22 applies a uniform charge to the surface of the photosensitive drum 20. At this time, a drive force is inputted from the apparatus-side coupling through the left flange part 101 of the photosensitive drum 20 and rotates the photosensitive drum 20 clockwise in a left side view.

Next, the scanning unit 16 irradiates the laser beam L diagonally downward and rearward onto the surface of the photosensitive drum 20. The laser beam L passes through the through-hole 97 formed in the drum cartridge 18, between the coupling parts 143 of the developing-cartridge handle 125, and over the developing-cartridge frame 25 to expose the front circumferential surface of the drum body 100 of the photosensitive drum 20, thereby forming an electrostatic latent image on the surface based on image data. Here, the image data may be transmitted to the printer 1 from a personal computer (not shown) or the like connected to the printer 1 or be read by the flatbed scanner 7, for example.

The agitator 29 agitates toner inside the toner accommodating section 127 and supplies the agitated toner through the through-hole 130 to the supply roller 27. The supply roller 27 in turn supplies this toner to the developing roller 26. At this time, the toner is positively tribocharged between the developing roller 26 and the supply roller 27, so that the developing roller 26 carries charged toner on the surface thereof. The thickness-regulating blade 28 then regulates the toner carried on the developing roller 26 in a uniform thickness.

The developing roller 26 supplies this toner having uniform thickness to the electrostatic latent image formed on the circumferential surface of the drum body 100. As a result, the drum body 100 carries a toner image thereon.

(2) Sheet-Feeding Operation

In the meantime, the feeding roller 8 rotates to separate and convey sheets P accommodated in the sheet cassette 9 one at a time along the first conveyance guide 6A of the conveyance guiding unit 6. Each sheet P is guided along the upstream portion of the first conveyance guide 6A to follow a U-shaped path leading to a path sloping downward to the rear, and then is supplied to the nipping point N between the drum body 100 and the transfer roller 21.

(3) Transferring and Fixing Operations

The toner image carried on the circumferential surface of the drum body 100 is transferred onto a sheet P as the sheet P passes through the nipping point N between the drum body 100 and the transfer roller 21 to transfer the toner image onto the sheet P. Subsequently, the sheet P passes between the heating roller 30 and the pressure roller 31 in the fixing unit 17. At this time, the toner image is thermally fixed to the sheet P by heat and pressure applied by the heating roller 30 and the pressure roller 31.

After the toner image is fixed to the sheet P, the sheet P is guided along the downstream portion of the first conveyance guide 6A along a U-shaped path that leads to a path sloping downward and forward, and arrives at a position between the discharge rollers 34. By rotating in a forward direction, the discharge rollers 34 discharge the sheet P through the discharge opening 68 onto the discharge tray 12. Through this operation, a sheet P accommodated in the sheet cassette 9 is conveyed along the conveying path T1 that is substantially S-shaped in a side view and defined by the first conveyance guide 6A.

(4) Duplex Printing Operation

To form images on both surfaces of a sheet P, the discharge rollers 34 are rotated in reverse before a sheet P having a toner image fixed on one surface is discharged into the discharge tray 12, reversing the conveying direction of the sheet P toward the second conveyance guide 6B. The sheet P is guided along the second conveyance guide 6B to follow a U-shaped path that leads to a forward path passing between the process cartridge 15 and the sheet cassette 9. The sheet P is returned from the second conveyance guide 6B to the first conveyance guide 6A at a position upstream of the nipping point N between the photosensitive drum 20 and the transfer roller 21.

Subsequently, the sheet P is once again conveyed through the nipping point N between the photosensitive drum 20 and the transfer roller 21 to transfer the toner image onto the other surface of the sheet P, and the toner image is thermally fixed to the sheet P as the sheet P passes between the heating roller 30 and the pressure roller 31, as described above. Subsequently, the discharge rollers 34 rotating in the forward direction discharge the sheet P onto the discharge tray 12.

(5) Inhibition of Gas Deposits on the Discharge Wire

Sometimes gas is produced in the fixing unit 17 during the fixing operation described above. This gas may contact and become deposited on the discharge wire 22A of the scorotron charger 22, potentially causing discharge problems of the discharge wire 22A.

However, in the first embodiment described above, the cover part 94B of the charger support wall 94 is provided between the scorotron charger 22 and the fixing unit 17 in the front-rear direction. The cover part 94B prevents gas produced in the fixing unit 17 from reaching the discharge wire 22A.

Further, the opening 95 faces in a direction diagonally upward and forward which is opposite to the fixing unit 17 in the front-rear direction. This configuration prevents gas produced in the fixing unit 17 from passing through the opening 95 and reaching the discharge wire 22A, thereby reducing the occurrence of discharge problems in the discharge wire 22A.

Further, since the lowest end of the discharge tray 12 is positioned between the scorotron charger 22 and the fixing unit 17 in the front-rear direction, the discharge tray 12 can further prevent gas produced in the fixing unit 17 from reaching the discharge wire 22A. That is, the rotational shaft 78 is disposed between the discharge wire 22A and the fixing unit 17 in the front-rear direction, thereby preventing the gas produced in the fixing unit 17 from reaching the discharging wire 22A.

5. Operations for Mounting and Removing the Process Cartridge Relative to the Main Casing Next, operations for removing the process cartridge 15 from the main casing 2 and for mounting the process cartridge 15 into the main casing 2 will be described.

(1) Removing the Process Cartridge from the Main Casing

The operations for removing the process cartridge 15 from the main casing 2, i.e., for moving the process cartridge 15 from the internal position to the external position, will be described.

As shown in FIG. 3, the user standing on the front side of the printer 1, i.e., the side of the scanning unit 16 opposite the process cartridge 15 when the process cartridge 15 is at the internal position, pivots the flatbed scanner 7 counterclockwise about the shaft 44 in a left side view and then pivots the top cover 11 about the rotational shaft 78 from the closed position to the open position. Note that the pivotal movement of the top cover 11 from the closed position to the open position may be in conjunction with the pivotal movement of the flatbed scanner 7 through a known interlocking mechanism.

Through this operation, space allowing the removal of the process cartridge 15 is formed between the front ends of the flatbed scanner 7 and the cover body 79, and the first wall section 65, and thus the grip part 120 and the grip part 144 are exposed.

Next, the user grips the grip part 120 and pulls the grip part 120 diagonally upward and forward. As the grip part 120 is pulled, the collars 92 are guided first in the narrow sections 58 of the corresponding grooves 53 and then along the bottom edges of the corresponding wide sections 57, enabling the process cartridge 15 to be pulled diagonally upward and forward.

The process cartridge 15 subsequently passes diagonally upward and forward through the space formed between the front ends of the cover body 79 and flatbed scanner 7, and the first wall section 65. The process cartridge 15 is removed from the main casing 2. In other words, the process cartridge 15 passes above the scanning unit 16 and between the flatbed scanner 7 and the scanning unit 16 and then is removed from the main casing 2.

During this operation, the bottom portion of the process cartridge 15, and specifically the bottom wall 88 and the transfer-roller accommodating section 89 slide sequentially on the second sloped section 70B and the first sloped section 70A of the first wall section 65 and are guided thereby. Once the process cartridge 15 has been moved from the internal position to the external position in this way, the operations for removing the process cartridge 15 from the main casing 2 are complete.

(2) Mounting the Process Cartridge in the Main Casing

To mount the process cartridge 15 in the main casing 2, the above operations for removing the process cartridge 15 are performed in reverse.

More specifically, the user pivots the flatbed scanner 7 counterclockwise in a left side view and moves the top cover 11 to the open position, as shown in FIG. 3. Next, the user passes the process cartridge 15 through the space between the cover body 79 and the flatbed scanner 7, and the first wall section 65. The user inserts the process cartridge 15 into the main casing 2 through the access opening 10. In other words, the process cartridge 15 passes over the scanning unit 16, between the flatbed scanner 7 and the scanning unit 16 and then is inserted into the main casing 2. At this time, the collars 92 are inserted into the wide sections 57 of the corresponding grooves 53.

Next, the user pushes the process cartridge 15 diagonally downward and rearward into the main casing 2. Through this operation, the collars 92 are guided along the bottom edges of the wide sections 57 of the grooves 53, slide from the wide sections 57 into the narrow sections 58, and then are guided to the bottom ends of the narrow sections 58. In this way, the process cartridge 15 is moved from the external position to the internal position and is now mounted in the main casing 2.

Next, the user moves the top cover 11 from the open position to the closed position, and pivots the flatbed scanner 7 clockwise in a left side view until the flatbed scanner 7 contacts the second wall section 66, as shown in FIG. 1. This completes the operations for mounting the process cartridge 15 in the main casing 2.

When the process cartridge 15 is at the internal position described above, the scorotron charger 22, the developing roller 26, the toner accommodating section 127, the scanning unit 16, and the feeding roller 8 are all positioned forward of a vertical plane I passing vertically through the rotational axis A of the photosensitive drum 20, while the fixing unit 17 and the discharge rollers 34 are positioned rearward of the vertical plane I. The plane I is a plane orthogonal to the front-rear direction. The scorotron charger 22 is positioned on the scanning unit 16 side of the vertical plane I.

Further, the drum-cartridge frame 23 is disposed on the rear side of the scanning unit 16 and is arranged adjacent to the scanning unit 16 in the front-rear direction. That is, the drum-cartridge frame 23 partially overlaps the scanning unit 16 as viewed in the front-rear direction. The scanning unit 16, the toner accommodating section 127, the developing roller 26, and the photosensitive drum 20 are sequentially arranged in the front-rear direction from the front side toward the rear side.

6. Operations for Mounting and Removal of the Developing Cartridge Relative to the Main Casing Next, operations for removing the developing cartridge 19 from and mounting the developing cartridge 19 in the main casing 2 will be described.

To remove the developing cartridge 19 from the main casing 2, as in the operations for removing the process cartridge 15 from the main casing 2 described above, the user pivots the flatbed scanner 7 counterclockwise in a left side view and moves the top cover 11 to the open position, as shown in FIG. 2.

This operation creates sufficient space allowing the developing cartridge 19 to pass therethrough between the front edges of the cover body 79 and the flatbed scanner 7, and the first wall section 65. Note that when the developing cartridge 19 is removed from the main casing 2, the space between the cover body 79 and the flatbed scanner 7, and the first wall section 65 may be narrower than the space required for removing the process cartridge 15 from the main casing 2 because the space need only allow passage of the developing cartridge 19.

The user then grips the grip part 144 of the developing-cartridge handle 125 and pulls the developing cartridge 19 diagonally upward and forward. At this time, the cylinders 135 shown in FIG. 6A are guided by the end parts 90C of the receiving grooves 90 to move diagonally downward and forward, while the bottom wall 127A of the toner accommodating section 127 is guided on the upper front surface of the protruding parts 96 to move diagonally downward and forward, as shown in FIGS. 1 and 2. Consequently, the developing cartridge 19 moves forward so that the developing roller 26 separates from the photosensitive drum 20.

As the user continues to pull the developing cartridge 19, the cylinders 135 are sequentially guided from the end parts 90C through the intermediate parts 90B to guide parts 90A to move upward and forward. Accordingly, the developing cartridge 19 moves diagonally upward and forward through the cartridge-mounting opening 99 and separates from the drum cartridge 18 of the process cartridge 15 in the internal position.

Subsequently, the developing cartridge 19 passes through the access opening 10 and is removed from the main casing 2 through the space formed between the cover body 79 and the flatbed scanner 7, and the first wall section 65. In other words, the developing cartridge 19 passes above the scanning unit 16 between the scanning unit 16 and the flatbed scanner 7 and then is removed from the main casing 2.

To mount the developing cartridge 19 in the main casing 2, the operations for removing the developing cartridge 19 described above are performed in reverse.

That is, the user pivots the flatbed scanner 7 and moves the top cover 11 to the open position, creating space allowing the developing cartridge 19 to pass between the front ends of the cover body 79 and the flatbed scanner 7, and the first wall section 65.

Next, the user passes the developing cartridge 19 through the space between the cover body 79 and the flatbed scanner 7, and the first wall section 65. The user inserts the developing cartridge 19 into the main casing 2 through the access opening 10. Hence, the developing cartridge 19 passes over the scanning unit 16 between the scanning unit 16 and the flatbed scanner 7 and then is inserted into the main casing 2.

Thereafter, the developing cartridge 19 is inserted downward and rearward through the cartridge-mounting opening 99 into the drum cartridge 18 of the process cartridge 15, which has been at the internal position. At this time, the cylinders 135 are inserted into the guide parts 90A of the corresponding receiving grooves 90.

As the user continues to push the developing cartridge 19 downward and rearward, the cylinders 135 are sequentially guided from the guide parts 90A through the intermediate parts 90B to the end parts 90C. Through this operation, the developing cartridge 19 moves diagonally downward and rearward and is accommodated in the accommodating space S formed in the drum cartridge 18. Thus, the receiving grooves 90 guide the developing cartridge 19 being mounted in or removed from the drum cartridge 18.

Subsequently, the user moves the top cover 11 from the open position to the closed position and pivots the flatbed scanner 7 clockwise in a left side view. The operation for mounting the developing cartridge 19 in the main casing 2 is complete.

7. Operational Advantages (1) As shown in FIG. 1, at least part of the grip part 120 is arranged above the scanning unit 16 so as to overlap the scanning unit 16 vertically when the process cartridge 15 is at the internal position. That is, the grip part 120 has a portion overlapped with the scanning unit 16 vertically when the process cartridge 15 is at the internal position. Accordingly, the user can reliably grip the grip part 120 and can smoothly remove the process cartridge 15 from the main casing 2, even when the front-rear space allocated between the process cartridge 15 and the scanning unit 16 is reduced. Thus, this arrangement allows the printer 1 to be made more compact in the front-rear dimension, while still enabling the process cartridge 15 to be removed smoothly from the main casing 2. The grip part 120 and the grip part 144 may be entirely overlapped with the scanning unit 16 vertically.

(2) As shown in FIG. 2, the developing cartridge 19 that accommodates toner therein is configured to be mounted in and removed from the drum cartridge 18. Therefore, the developing cartridge 19 that accommodates toner therein and the drum cartridge 18 that possesses the photosensitive drum 20 can be replaced separately, thereby reducing running costs.

Specifically, in case where the process cartridge integrally includes a photosensitive drum and accommodates therein toner, the process cartridge is removed from the casing and replaced with new one, when the toner accommodated in the process cartridge is consumed by the image forming operation and the amount of the toner drops below a prescribed amount. Here, when the process cartridge not only accommodates toner but also fixedly includes the photosensitive drum, the photosensitive drum needs to be replaced together with the process cartridge.

However, the photosensitive drum normally has a longer life than the period in which the toner accommodated in the process cartridge is dropped below the prescribed amount through the image-forming operations. Hence, if the photosensitive drum is integrally replaced together with the process cartridge, it is difficult to reduce running costs for the image-forming apparatus.

In the embodiment, the developing cartridge 19 accommodating toner therein is replaced separately from and independently of the drum cartridge 18 having the photosensitive drum 20, thereby reducing running costs.

Further, the drum cartridge 18 is provided with the grip part 120, as shown in FIG. 1. When the process cartridge 15 is mounted in the main casing 2, at least part of the grip part 120 is positioned above the scanning unit 16 so as to overlap the scanning unit 16 vertically. Accordingly, the user can reliably grip the grip part 120 and can smoothly remove the developing cartridge 19 and the drum cartridge 18 from the main casing 2 as the integral process cartridge 15. Hence, this arrangement enables the process cartridge 15 to be smoothly removed from the main casing 2 while achieving a reduction in running costs.

(3) As shown in FIG. 1, the developing cartridge 19 includes the grip part 144. When the process cartridge 15 is at the internal position, at least part of the grip part 144 is arranged above the scanning unit 16 so as to overlap the scanning unit 16 vertically. That is, the grip part 144 has a portion overlapped with the scanning unit 16 vertically. Accordingly, the user can reliably grip the grip part 144 and can smoothly remove the developing cartridge 19 from the main casing 2, as shown in FIG. 2.

(4) As shown in FIG. 4, the grip part 144 is disposed adjacent to the rear of the grip part 120. That is, the grip part 144 and the grip part 120 are arrayed with each other in the front-rear direction. Hence, when removing the developing cartridge 19 or the process cartridge 15 from the main casing 2, the user can clearly determine whether to grip the grip part 120 or the grip part 144. Thus, the user can more easily remove the developing cartridge 19 and the process cartridge 15 from the main casing 2.

(5) As shown in FIG. 1, the drum cartridge 18 has the through-hole 97 formed in the front wall 93 through which the laser beam L emitted from the scanning unit 16 passes to reach the photosensitive drum 20. Accordingly, this construction restrains the drum cartridge 18 from interfering with the laser beam L, preventing interference with the exposure of the photosensitive drum 20.

(6) As shown in FIG. 1, the grip part 120 is disposed above the irradiating path of the laser beam L. Therefore, the user can easily access the grip part 120. Further, since the laser beam L passes beneath the grip part 120, the grip part 120 is restrained from interfering with the exposure of the photosensitive drum 20.

(7) As shown in FIG. 1, the developing cartridge 19 is provided in the main casing 2 such that the developing roller 26 in the developing cartridge 19 is disposed beneath the irradiating path of the laser beam L. Hence, space in the main casing 2 beneath the irradiating path of the laser beam L can be used for arranging the developing cartridge 19 and the developing-cartridge frame 25, thereby ensuring an efficient arrangement of the developing cartridge 19.

Further, since the grip part 120 is disposed above the irradiating path of the laser beam L, the user can easily grip the grip part 120 despite the developing cartridge 19 being positioned beneath the irradiating path of the laser beam L, as described above. Hence, this construction allows the user to smoothly remove the process cartridge 15 from the main casing 2.

(8) As shown in FIG. 3, the main casing 2 is formed with the access opening 10, and the process cartridge 15 is reliably mounted in and removed from the main casing 2 through the access opening 10. Since the access opening 10 is disposed at the rear side of the scanning unit 16, the scanning unit 16 is positioned between the user and the process cartridge 15 positioned at the internal position when the user accesses the process cartridge 15 from the front side of the scanning unit 16. Thus, this arrangement increases the distance from the user to the process cartridge 15, which may lead to bothersome operations for removing the process cartridge 15 from the main casing 2 due to the far distance between the front side of the main casing and the process cartridge 15.

However, in the preferred embodiment, at least part of the grip part 120 is provided above the scanning unit 16 so as to overlap the scanning unit 16 vertically when the process cartridge 15 is at the internal position shown in FIG. 1. Accordingly, even though the access opening 10 is positioned to the rear of the scanning unit 16, the user can easily access the grip part 120 and smoothly remove the process cartridge 15 from the main casing 2.

(9) As shown in FIGS. 1 through 3, the top cover 11 moves between the closed position and the open position. Thus, when the top cover 11 is at the closed position, the top cover 11 can prevent the external light from penetrating the main casing 2 through the access opening 10. This configuration reduces the amount of external light that reaches the photosensitive drum 20, thereby suppressing degradation of the photosensitive drum 20 and the formation of erratic electrostatic latent images on the surface of the photosensitive drum 20.

On the other hand, the access opening 10 is exposed when the top cover 11 is at the open position, enabling the user to reliably mount the process cartridge 15 in and remove the process cartridge 15 from the main casing 2 through the access opening 10.

(10) As shown in FIG. 1, the rotational shaft 78 is disposed at the upper rear side of the process cartridge 15 when the process cartridge 15 is at the internal position. The cover body 79 of the top cover 11 is arranged above the process cartridge 15 when the process cartridge 15 is at the internal position. Hence, the front edge of the cover body 79 is positioned forward from the rotational shaft 78. As a result, the user can easily access the front edge of the cover body 79 from the front side of the scanning unit 16. By operating the front edge of the cover body 79, the user can reliably move the top cover 11 between the closed position and the open position.

(11) As shown in FIG. 1, the rotational shaft 78 is disposed between the fixing unit 17 and the scorotron charger 22 in the front-rear direction. Accordingly, the rotational shaft 78 can restrain gas generated from the fixing unit 17 from reaching the scorotron charger 22.

(12) As shown in FIG. 1, the printer 1 is provided with the flatbed scanner 7 for reading the document. Therefore, the printer 1 can form images on sheets P based on image data of the document read by the flatbed scanner 7.

Further, when the process cartridge 15 is being mounted in or removed from the main casing 2, as shown in FIG. 3, the process cartridge 15 passes between the scanning unit 16 and the flatbed scanner 7. Thus, the flatbed scanner 7 can be arranged so as not to interfere with the mounting and removal of the process cartridge 15.

(13) As shown in FIG. 1, the feeding roller 8 is disposed at the front side of the process cartridge 15 when the process cartridge 15 is at the internal position. The fixing unit 17 is disposed at the rear side of the process cartridge 15 when the process cartridge 15 is at the internal position. In other words, the feeding roller 8, the process cartridge 15, and the fixing unit 17 are aligned with each other in the front-rear direction, enabling the printer 1 to be compact in the vertical direction.

(14) As shown in FIGS. 5A and 5B, the grip part 120 pivots about the pivoting shafts 115, thereby improving the operation of the grip part 120.

(15) As shown in FIG. 1, the scorotron charger 22 is disposed at the scanning unit 16 side of the vertical plane I. This layout ensures a more efficient arrangement of the scorotron charger 22.

8. Second Through Fifth Embodiments

Next, second through fifth embodiments of the image-forming apparatus according to the present disclosure will be described with reference to FIGS. 7 through 10, wherein like parts and components are designated with the same reference numerals to avoid duplicating description.

(1) Second Embodiment

Figure 7:
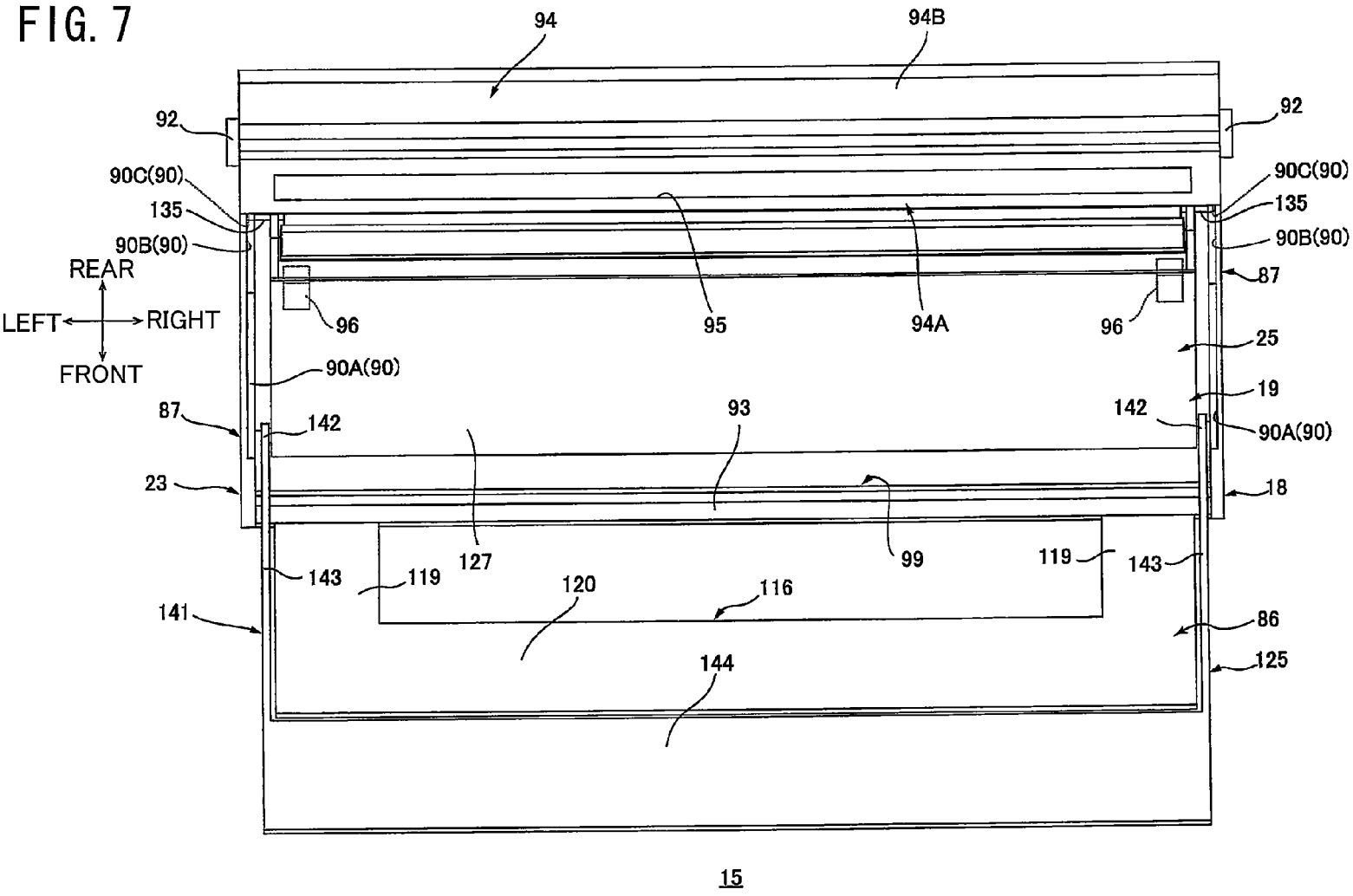
FIG. 7 is a plan view of a process cartridge according to a second embodiment.
Figure 8:
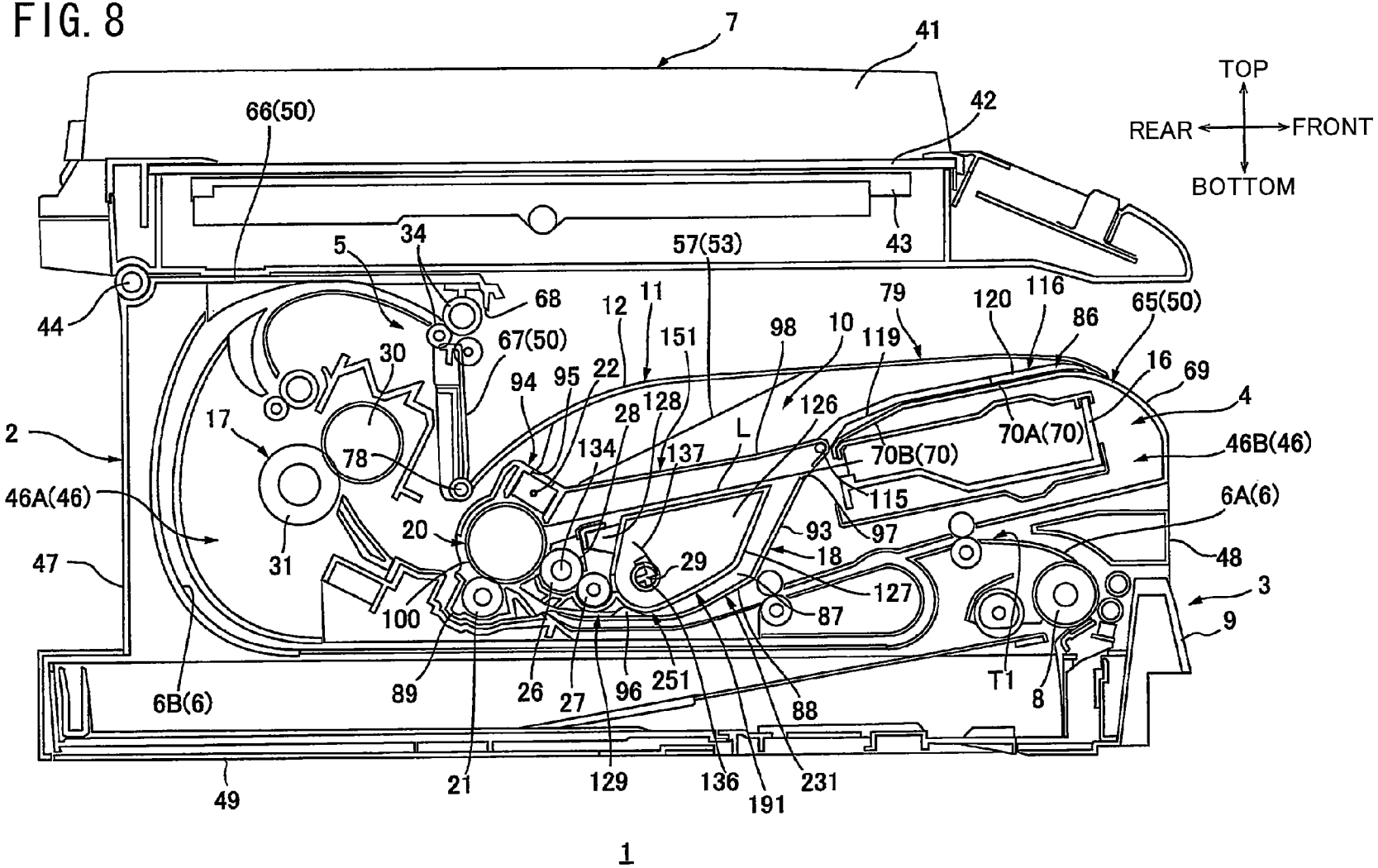
FIG. 8 is a cross-sectional view of a printer according to a third embodiment.
Figure 9:
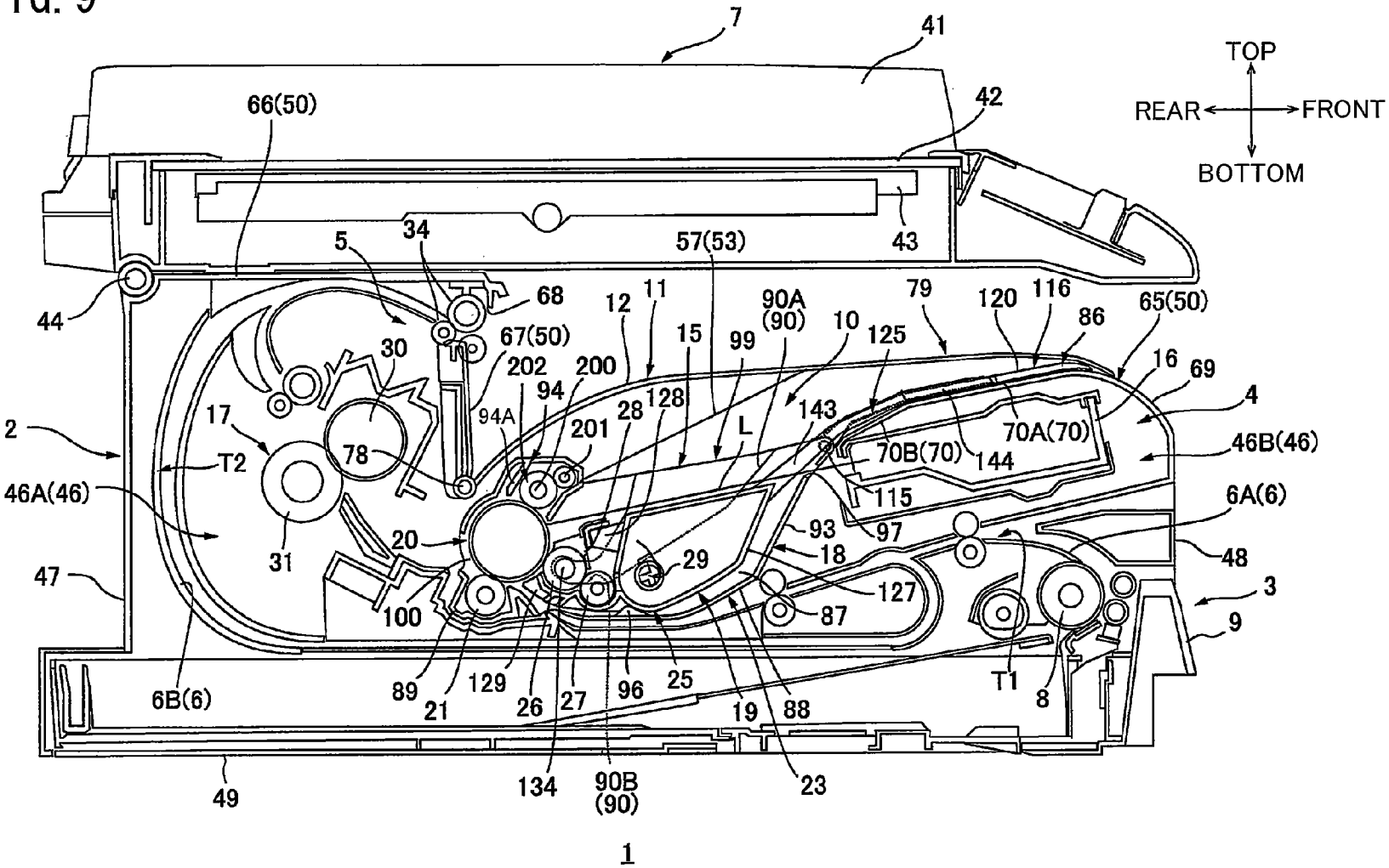
FIG. 9 is a cross-sectional view of a printer according to a fourth embodiment.

As shown in FIG. 4, the grip part 144 is disposed on the rear side of the grip part 120 in the first embodiment described above. However, in the second embodiment, the grip part 120 is disposed on the rear side of the grip part 144, as shown in FIG. 7. In the following description, like parts and components have been designated with the same reference numerals as those used in the first embodiment to avoid duplicating description.

In this case, the drum-cartridge handle 86 is fixed to the front wall 93 of the drum-cartridge frame 23. The left-right dimension of the drum-cartridge handle 86 is smaller than the left-right gap between the coupling parts 143 of the developing-cartridge handle 125, while the front-rear dimension of the drum-cartridge handle 86 is smaller than the front-rear gap between the front wall 93 and the grip part 144.

More specifically, the coupling parts 119 of the drum-cartridge handle 86 are separated from each other in the left-right direction. The coupling parts 119 have a plate-like structure that is generally rectangular in a plan view and elongated in the front-rear direction. The coupling parts 119 extend diagonally upward and forward from the left and right edges of the top edge of the front wall 93. The grip part 120 has a plate-like structure that is generally rectangular in a plan view and elongated in the left-right direction. The grip part 120 bridges the front ends of the coupling parts 119.

When the process cartridge 15 is at the internal position, the handle body 116 is disposed between the coupling parts 143 of the developing-cartridge handle 125 in the left-right direction, and the grip part 120 is disposed adjacent to the rear edge of the grip part 144 in the front-rear direction.

Further, the grip part 120 is disposed on the top surface of the rear region of the first sloped section 70A, while the grip part 144 is disposed on the top surface of the front portion of the first sloped section 70A. Accordingly, at least part of the grip part 120 and at least part of the grip part 144 are disposed above the scanning unit 16 so as to overlap the scanning unit 16 vertically.

Thus, the second embodiment can obtain the same operational advantages described above in the first embodiment.

(2) Third Embodiment

In the first embodiment described above, the developing cartridge 19 is removably mountable in the drum-cartridge frame 23, as shown in FIG. 1. In the third embodiment shown in FIG. 8, the printer 1 includes a process cartridge 151 having a drum-cartridge frame 231, a developing unit 191 integrally (i.e., non-removably) mounted in the drum-cartridge frame 231, the drum-cartridge handle 86. In the following description, like parts and components have been designated with the same reference numerals as those used in the first embodiment to avoid duplicating description.

The drum-cartridge frame 231 is integrally configured of the side walls 87, the bottom wall 88, the front wall 93, the transfer-roller accommodating section 89, the charger support wall 94, and a top wall 98.

The top wall 98 has a plate-like structure that is generally rectangular in a plan view. The front edge of the top wall 98 is connected to the top edge of the front wall 93. The rear edge of the top wall 98 is connected to the upper-front edge of the charger support wall 94. The left and right edges of the top wall 98 are respectively connected to the top edges of the corresponding side walls 87.

The developing unit 191 is disposed inside the drum-cartridge frame 231 and fixed thereto. The developing unit 191 has a developing-unit frame 251 integrally configured of the side walls 126, the toner accommodating section 127, the blade support part 128, and the bottom wall 129.

Note that the developing-cartridge handle 125 of the first embodiment is not provided on the developing unit 191 in the third embodiment. Only the drum-cartridge handle 86 is provided on the process cartridge 151.

The third embodiment having the above configuration can obtain the same operational advantages described above in the first embodiment.

(3) Fourth Embodiment

In the first embodiment described above, the process cartridge 15 is provided with the scorotron charger 22, as shown in FIG. 1. In the fourth embodiment, the process cartridge 15 may be provided with a charging unit 202 instead of the scorotron charger 22 of the first embodiment. In the following description, like parts and components have been designated with the same reference numerals as those used in the first embodiment to avoid duplicating description.

The charging unit 202 is accommodated in the body 94A of the charger support wall 94. The charging unit 202 includes a charging roller 200, and a cleaning roller 201.

The charging roller 200 is disposed diagonally upward and forward of the drum body 100 of the photosensitive drum 20. The charging roller 200 has a general columnar shape elongated in the left-right direction. The charging roller 200 is rotatably supported on the drum-cartridge frame 23. The lower-rear surface of the charging roller 200 contacts the upper-front surface of the drum body 100. During the image-forming operation described above, the charging roller 200 applies a uniform charge to the circumferential surface of the drum body 100.

The cleaning roller 201 is disposed diagonally upward and forward of the charging roller 200. The cleaning roller 201 has a general columnar shape elongated in the left-right direction. The cleaning roller 201 is rotatably supported on the drum-cartridge frame 23. The lower-rear surface of the cleaning roller 201 contacts the upper-front surface of the cleaning roller 200. The cleaning roller 201 is configured to collect toner particles, dust particles, or other matter deposited on the circumferential surface of the charging roller 200.

The fourth embodiment having this configuration can obtain the same operational advantages described above in the first embodiment.

(4) Fifth Embodiment

In the first embodiment described above, the developing cartridge 19 is removably mountable in the drum cartridge 18 having the photosensitive drum 20. However, in the fifth embodiment shown in FIG. 10, the photosensitive drum 20 is fixedly provided in the main casing 2, and the developing cartridge 19 is removably mountable in the main casing 2. In the following description, like parts and components have been designated with the same reference numerals as those used in the first embodiment to avoid duplicating description.

In this case, the main casing 2 includes the photosensitive drum 20, the transfer roller 21, and the scorotron charger 22, which are not removably provided therein.

The photosensitive drum 20 is disposed in the approximate center region of the main casing 2 at a position rearward of the scanning unit 16 and on the lower-front side of the fixing unit 17 but spaced apart from both the scanning unit 16 and the fixing unit 17. The left and right ends of the photosensitive drum 20 are rotatably supported on the rear ends of the front portions 46B of the side walls 46.

The transfer roller 21 is disposed diagonally downward and rearward of the photosensitive drum 20. The left and right ends of the transfer roller 21 are rotatably supported on the lower-rear portion of the front portions 46B of the side walls 46. The scorotron charger 22 is disposed diagonally upward and forward of the photosensitive drum 20 with a gap therebetween. The left and right ends of the scorotron charger 22 are supported on the upper-rear portion of the front portions 46B of the side walls 46.

In the fifth embodiment, the receiving grooves 90 are formed at the inner left-right surfaces of the front portions 46B of the side walls 46. The receiving grooves 90 are recessed outward in the left-right direction from the inner left-right surfaces of the corresponding front portions 46B of the side walls 46. Each receiving groove 90 has the guide part 90A, the intermediate part 90B, and the end part 90C.

The guide part 90A extends diagonally downward and rearward from the approximate front-rear center region on the top edge of the front portion 46B of the corresponding side wall 46. The guide part 90A becomes narrower toward the lower-rear end. The intermediate part 90B extends continuously rearward from the bottom end of the guide part 90A. The end part 90C curves continuously upward and rearward from the rear end of the intermediate part 90B.

Figure 10:
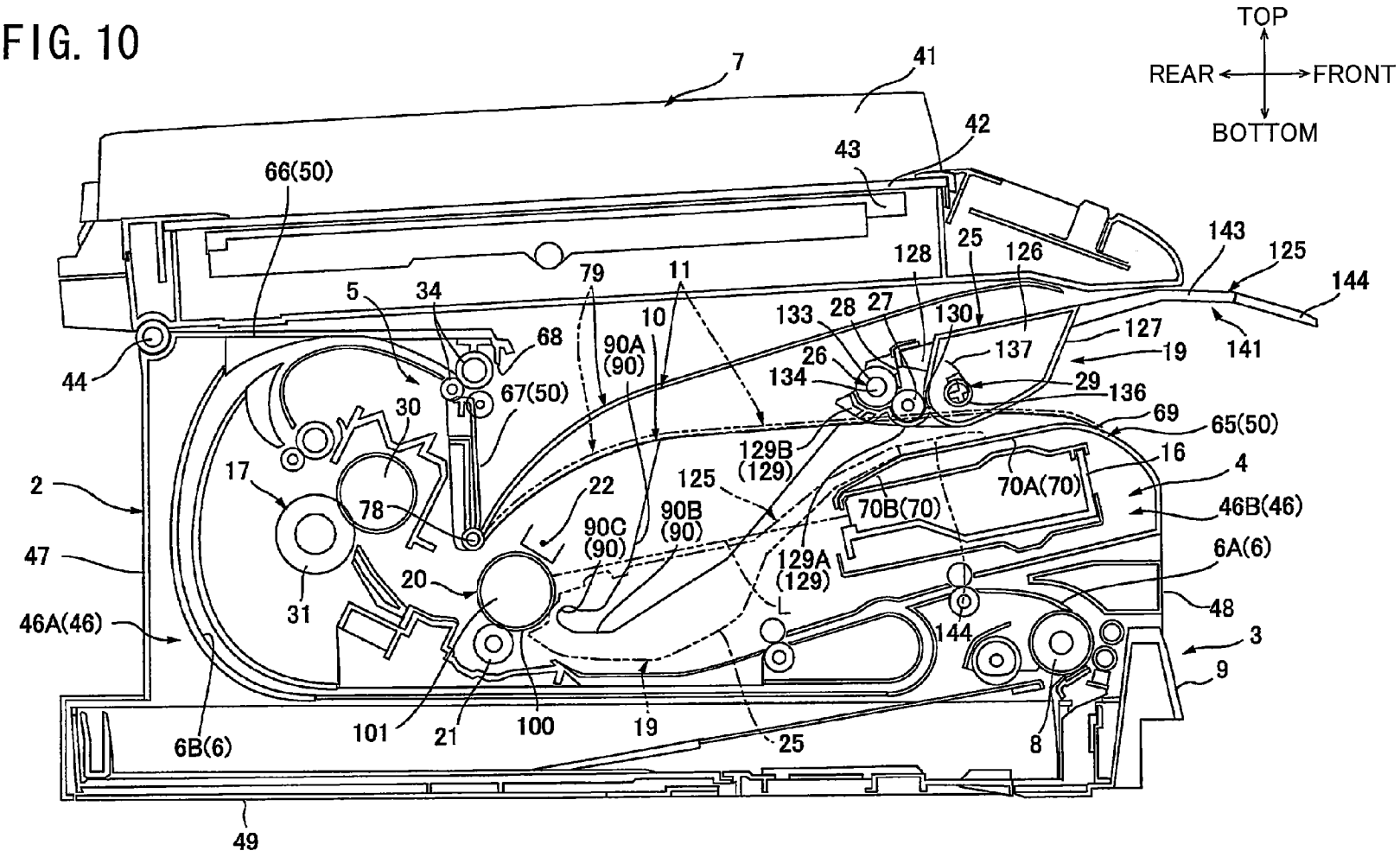
FIG. 10 is a cross-sectional view of a printer according to a fifth embodiment.

In the printer 1 having the above structure, the developing cartridge 19 is mounted in the main casing 2 such that the developing-cartridge frame 25 is disposed between the photosensitive drum 20 and the scanning unit 16 in the front-rear direction, as depicted in FIG. 10 in two-dot chain line. Thus, the scanning unit 16 is disposed in front of the developing-cartridge frame 25 of the developing cartridge 19 when the developing cartridge 19 is mounted in the main casing 2. Further, the developing-cartridge frame 25 is positioned below the irradiating path of the laser beam L and the developing roller 26 is also disposed below the irradiating path of the laser beam L.

When the developing cartridge 19 is mounted in the main casing 2, the cylinders 135 are inserted in the end parts 90C of the corresponding receiving grooves 90, and the upper-rear surface of the roller body 133 of the developing roller 26 contacts the lower-front surface of the drum body 100 of the photosensitive drum 20. Further, the grip part 144 of the developing-cartridge handle 125 is disposed at the rear region of the top surface of the first sloped section 70A. Thus, at least part of the grip part 144 is disposed above the scanning unit 16 so as to overlap the scanning unit 16 vertically and is positioned above the irradiating path of the laser beam L.

Further, when the top cover 11 is at the closed position, the cover body 79 of the top cover 11 is disposed above the developing cartridge 19 mounted in the main casing 2 with a space therebetween. At this time, the rotational shaft 78 is positioned at the upper-rear side of the developing cartridge 19.

As described in the first embodiment, when the developing cartridge 19 is removed from the main casing 2, the flatbed scanner 7 pivotally moves counterclockwise about the shaft 44 in a left side view and then the top cover 11 is at the open position. Next, the user grips the grip part 144 of the developing-cartridge handle 125 and pulls the developing cartridge 19 diagonally upward and forward. At this time, the cylinders 135 sequentially move from the end parts 90C through the intermediate parts 90B to the guide parts 90A while being guided thereby. As a result, the developing cartridge 19 moves diagonally upward and forward, passing through the access opening 10 and subsequently passing through the space between the cover body 79 and flatbed scanner 7, and the first wall section 65 before being extracted from the main casing 2.

To mount the developing cartridge 19 in the main casing 2, the above operations for removing the developing cartridge 19 are performed in reverse.

That is, the user passes the developing cartridge 19 through the space between the cover body 79 and flatbed scanner 7, and the first wall section 65. The user inserts the developing cartridge 19 into the main casing 2 through the access opening 10. At this time, the cylinders 135 are inserted first into the corresponding guide parts 90A, subsequently pass through the intermediate parts 90B, and then arrive at the end parts 90C. Through this operation, the developing cartridge 19 moves diagonally downward and rearward to be mounted in the main casing 2.

According to the fifth embodiment described above, at least part of the grip part 144 is arranged above the scanning unit 16 so as to overlap the scanning unit 16 vertically when the developing cartridge 19 is mounted in the main casing 2. Accordingly, the user can reliably grip the grip part 144 and smoothly remove the developing cartridge 19 from the main casing 2, despite a reduction in space between the developing cartridge 19 and the scanning unit 16 in the front-rear direction.

Thus, the fifth embodiment described above can make the printer 1 more compact in the front-rear direction while still enabling the developing cartridge 19 to be smoothly removed from the main casing 2.

Note that the first through fifth embodiments described above may be combined as appropriate.

While the description has been made in detail with reference to the embodiments thereof, it would be apparent to those skilled in the art that various changes and modifications may be made therein without departing from the spirit and scope of the above described embodiments.

What is claimed is:

1. An image forming apparatus comprising:

a casing defining a first direction, a second direction orthogonal to the first direction, and a third direction orthogonal to the first direction and the second direction, the third direction extending vertically;

a process cartridge configured to be mounted in and removed from the casing, the process cartridge comprising:

a photosensitive body extending in the first direction;

a grip having a portion;

a developing agent accommodating section accommodating therein developing agent; and a developing section including a developing roller; and an exposure unit configured to expose the photosensitive body, the exposure unit having a part overlapped with the process cartridge as viewed in the second direction when the process cartridge is mounted in the casing, the portion of the grip being overlapped with the exposure unit as viewed in the third direction and disposed above the exposure unit in the third direction when the process cartridge is mounted in the casing, wherein the developing agent accommodating section is disposed entirely between the photosensitive drum and the exposure unit when the process cartridge is mounted in the casing.

2. The image forming apparatus according to claim 1, wherein the process cartridge comprises:

a photosensitive cartridge having the photosensitive body; and a developing cartridge configured to be mounted in and removed from the photosensitive cartridge and having the developing agent accommodating section and the developing section, wherein the grip is provided at the photosensitive cartridge.

3. The image forming apparatus according to claim 1, wherein the process cartridge comprises:

a photosensitive cartridge having the photosensitive body; and a developing cartridge configured to be mounted in and removed from the photosensitive cartridge and having the developing agent accommodating section and the developing section, wherein the grip is provided at the developing cartridge.

4. The image forming apparatus according to claim 1, wherein the process cartridge comprises:

a photosensitive cartridge having the photosensitive body; and a developing cartridge configured to be mounted in and removed from the photosensitive cartridge and having the developing agent accommodating section and the developing section wherein the grip comprises a first grip provided at the photosensitive cartridge and a second grip provided at the developing cartridge.

5. The image forming apparatus according to claim 4, wherein the first grip and the second grip are arrayed with each other in the second direction.

6. The image forming apparatus according to claim 1, wherein the exposure unit is configured to emit laser beam toward the photosensitive body, wherein the process cartridge is formed with an opening configured to allow the laser beam to pass therethrough.

7. The image forming apparatus according to claim 6, wherein the process cartridge comprises:

a photosensitive cartridge having the photosensitive body; and a developing cartridge configured to be mounted in and removed from the photosensitive cartridge and having the developing agent accommodating section and the developing section, the opening being formed at the photosensitive cartridge.

8. The image forming apparatus according to claim 6, wherein the laser beam travels along an irradiating path, the grip being disposed above the irradiating path in the third direction.

9. The image forming apparatus according to claim 7, wherein the laser beam travels along an irradiating path, wherein the developing roller is configured to supply the developing agent to the photosensitive body, the developing roller being disposed below the irradiating path in the third direction.

10. The image forming apparatus according to claim 1, wherein the exposure unit has a first side and a second side opposite to the first side in the second direction, the process cartridge being moved from the first side toward the second side to mount the process cartridge in the casing, and wherein the casing defines an access opening configured to allow the process cartridge to pass therethrough, the access opening being positioned at the second side in the second direction.

11. The image forming apparatus according to claim 1, further comprising an image reading unit configured to read image data from a document, the image reading unit being disposed above the casing in the third direction, wherein the image reading unit and the exposure unit define a space therebetween to allow the process cartridge to pass through the space so as to mount and remove the process cartridge in and from the casing.

12. The image forming apparatus according to claim 1, further comprising a grip unit having a pivotal shaft and the grip configured to be pivotally movable about the pivotal shaft.

13. An image forming apparatus comprising:

a casing defining a first direction, a second direction orthogonal to the first direction, and a third direction orthogonal to the first direction and the second direction, the third direction extending vertically;

a photosensitive body extending in the first direction, the photosensitive body being fixedly provided in the casing;

a developing cartridge configured to be mounted in and removed from the casing, the developing cartridge comprising:

a grip having a portion;

a developing agent accommodating section accommodating therein developing agent; and a developing section including a developing roller; and an exposure unit configured to expose the photosensitive body, the exposure unit having a part overlapped with the developing cartridge as viewed in the second direction when the developing cartridge is mounted in the casing, the portion of the grip being overlapped with the exposure unit as viewed in the third direction and disposed above the exposure unit in the third direction when the developing cartridge is mounted in the casing, wherein the developing agent accommodating section is disposed entirely between the photosensitive drum and the exposure unit when the developing cartridge is mounted in the casing.

14. The image forming apparatus according to claim 13, wherein the exposure unit is configured to emit laser beam toward the photosensitive body, the laser beam traveling along an irradiating path, the grip being disposed above the irradiating path in the third direction.

15. The image forming apparatus according to claim 14, wherein the developing roller is configured to supply the developing agent to the photosensitive body, the developing roller being disposed below the irradiating path in the third direction.

16. The image forming apparatus according to claim 13, wherein the exposure unit has a first side and a second side opposite to the first side in the second direction, the developing cartridge being moved from the first side toward the second side to mount the developing cartridge in the casing, and wherein the casing defines an access opening configured to allow the developing cartridge to pass therethrough, the access opening being positioned at the second side in the second direction.

17. The image forming apparatus according to claim 13, further comprising an image reading unit configured to read image data from a document, the image reading unit being disposed above the casing in the third direction, wherein the image reading unit and the exposure unit define a space therebetween to allow the developing cartridge to pass through the space so as to mount and remove the developing cartridge in and from the casing.

18. An image forming apparatus comprising:

a casing defining a first direction, a second direction orthogonal to the first direction, and a third direction orthogonal to the first direction and the second direction, the third direction extending vertically;

a process cartridge configured to be mounted in and removed from the casing, the process cartridge comprising:

a photosensitive body extending in the first direction;

a grip having a portion;

a developing agent accommodating section accommodating therein developing agent; and a developing section including a developing roller; and an exposure unit configured to expose the photosensitive body and emit laser beam toward the photosensitive body such that the laser beam travels along an irradiating path, the exposure unit having a part overlapped with the process cartridge as viewed in the second direction when the process cartridge is mounted in the casing, the portion of the grip being overlapped with the exposure unit as viewed in the third direction and disposed above the exposure unit in the third direction when the process cartridge is mounted in the casing, wherein the developing agent accommodating section is disposed below the irradiating path in the third direction when the process cartridge is mounted in the casing.

19. The image forming apparatus according to claim 18, wherein the process cartridge comprises:

a photosensitive cartridge having the photosensitive body; and a developing cartridge configured to be mounted in and removed from the photosensitive cartridge and having the developing agent accommodating section and the developing section, wherein the grip is provided at the photosensitive cartridge.

20. The image forming apparatus according to claim 18, wherein the process cartridge comprises:

a photosensitive cartridge having the photosensitive body; and a developing cartridge configured to be mounted in and removed from the photosensitive cartridge and having the developing agent accommodating section and the developing section, wherein the grip is provided at the developing cartridge.

21. The image forming apparatus according to claim 18, wherein the process cartridge comprises:

a photosensitive cartridge having the photosensitive body; and a developing cartridge configured to be mounted in and removed from the photosensitive cartridge and having the developing agent accommodating section and the developing section, wherein the grip comprises a first grip provided at the photosensitive cartridge and a second grip provided at the developing cartridge.

22. The image forming apparatus according to claim 21, wherein the first grip and the second grip are arrayed with each other in the second direction.

23. The image forming apparatus according to claim 18, wherein the process cartridge is formed with an opening configured to allow the laser beam to pass therethrough.

24. The image forming apparatus according to claim 23, wherein the process cartridge comprises:

a photosensitive cartridge having the photosensitive body; and a developing cartridge configured to be mounted in and removed from the photosensitive cartridge and having the developing agent accommodating section and the developing section, the opening being formed at the photosensitive cartridge.

25. The image forming apparatus according to claim 24, wherein the developing roller is configured to supply the developing agent to the photosensitive body, the developing roller being disposed below the irradiating path in the third direction.

26. The image forming apparatus according to claim 23, wherein the grip is disposed above the irradiating path in the third direction.

27. The image forming apparatus according to claim 18, wherein the exposure unit has a first side and a second side opposite to the first side in the second direction, the process cartridge being moved from the first side toward the second side to mount the process cartridge in the casing; and wherein the casing defines an access opening configured to allow the process cartridge to pass therethrough, the access opening being positioned at the second side in the second direction.

28. The image forming apparatus according to claim 18, further comprising an image reading unit configured to read image data from a document, the image reading unit being disposed above the casing in the third direction, wherein the image reading unit and the exposure unit define a space therebetween to allow the process cartridge to pass through the space so as to mount and remove the process cartridge in and from the casing.

29. The image forming apparatus according to claim 18, further comprising a grip unit having a pivotal shaft and the grip configured to be pivotally movable about the pivotal shaft.

* * * * *